US007414602B2

(12) United States Patent
Kobashi

(10) Patent No.: US 7,414,602 B2
(45) Date of Patent: Aug. 19, 2008

(54) METHOD OF DRIVING LIQUID CRYSTAL DISPLAY DEVICE, LIQUID CRYSTAL DISPLAY DEVICE, AND PORTABLE ELECTRONIC APPARATUS

(75) Inventor: Yutaka Kobashi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 603 days.

(21) Appl. No.: 10/921,811

(22) Filed: Aug. 20, 2004

(65) Prior Publication Data

US 2005/0052393 A1 Mar. 10, 2005

(30) Foreign Application Priority Data

Aug. 26, 2003 (JP) ..... 2003-301589

(51) Int. Cl.
*G09G 3/36* (2006.01)

(52) U.S. Cl. ..... 345/87; 345/89; 345/92; 345/98; 345/103

(58) Field of Classification Search ..... 345/87–100, 345/204, 205, 60, 174, 103; 349/43, 151, 349/158, 38, 40, 54, 141; 313/498; 326/83
See application file for complete search history.

(56) References Cited

U.S. PATENT DOCUMENTS

| | | | | |
|---|---|---|---|---|
| 4,795,239 | A | 1/1989 | Yamashita et al. | |
| 5,233,448 | A * | 8/1993 | Wu | 349/40 |
| 5,642,134 | A * | 6/1997 | Ikeda | 345/174 |
| 5,943,033 | A * | 8/1999 | Sugahara et al. | 345/85 |
| 5,994,916 | A | 11/1999 | Hayashi | |
| 6,005,542 | A * | 12/1999 | Yoon | 345/92 |
| 6,052,104 | A | 4/2000 | Lee | |
| 6,084,562 | A | 7/2000 | Onda | |
| 6,177,968 | B1 * | 1/2001 | Okada et al. | 349/38 |
| 6,229,515 | B1 * | 5/2001 | Itoh et al. | 345/103 |
| 6,297,867 | B1 * | 10/2001 | Miyahara et al. | 349/141 |
| 6,304,309 | B1 | 10/2001 | Yamanaka et al. | |
| 6,369,788 | B1 | 4/2002 | Yamazaki et al. | |
| 6,483,565 | B1 | 11/2002 | Hidehira | |
| 6,753,935 | B2 * | 6/2004 | Wu | 349/54 |
| 6,791,523 | B2 * | 9/2004 | Fujita et al. | 345/92 |
| 6,888,304 | B2 * | 5/2005 | Sato | 313/498 |
| 6,893,906 | B2 | 5/2005 | Yamazaki et al. | |
| 6,897,932 | B2 * | 5/2005 | Murade et al. | 349/151 |
| 6,999,049 | B2 | 2/2006 | Hirata | |
| 7,167,154 | B2 * | 1/2007 | Sato et al. | 345/100 |
| 7,196,697 | B2 * | 3/2007 | Yamazaki | 345/204 |
| 7,221,413 | B2 * | 5/2007 | Lai | 349/38 |

(Continued)

FOREIGN PATENT DOCUMENTS

| | | |
|---|---|---|
| CN | 1410958 A | 4/2003 |
| JP | A-62-49399 | 3/1987 |
| JP | A 04-177327 | 6/1992 |
| JP | U 07-033075 | 6/1995 |
| JP | A 08-166499 | 6/1996 |

(Continued)

*Primary Examiner*—Prabodh Dharia
(74) *Attorney, Agent, or Firm*—Oliff & Berridge, PLC

(57) ABSTRACT

To enable a common inversion driving even in an LCD having a large size and a high definition. A common capacitance is significantly reduced by making most of scanning lines in a floating state during the common inversion. In addition, the timing for floating the scanning lines is changed depending on the polarity of the common potential. Specifically, if a pixel switching element is an N channel type, the scanning lines are floated when the common potential is high. If the pixel switching element is a P channel type, the scanning lines are floated when the common potential is low.

20 Claims, 14 Drawing Sheets

U.S. PATENT DOCUMENTS

| | | | | |
|---|---|---|---|---|
| 7,312,638 | B2 * | 12/2007 | Kobashi | 326/83 |
| 2001/0050664 | A1 | 12/2001 | Yamazaki et al. | |
| 2001/0052898 | A1 * | 12/2001 | Osame et al. | 345/211 |
| 2002/0015031 | A1 * | 2/2002 | Fujita et al. | 345/204 |
| 2002/0030528 | A1 * | 3/2002 | Matsumoto et al. | 327/331 |
| 2002/0093469 | A1 * | 7/2002 | Suzuki et al. | 345/60 |
| 2002/0154084 | A1 * | 10/2002 | Tanaka et al. | 345/92 |
| 2003/0011583 | A1 * | 1/2003 | Yamazaki | 345/204 |
| 2003/0151572 | A1 * | 8/2003 | Kumada et al. | 345/87 |
| 2003/0197667 | A1 * | 10/2003 | Numao | 345/82 |
| 2004/0246216 | A1 * | 12/2004 | Hosaka | 345/87 |
| 2005/0237442 | A1 | 10/2005 | Yamazaki et al. | |
| 2005/0248558 | A1 * | 11/2005 | Kobashi | 345/204 |
| 2006/0232538 | A1 * | 10/2006 | Kobashi et al. | 345/94 |
| 2007/0008266 | A1 * | 1/2007 | Kobashi et al. | 345/90 |
| 2007/0063953 | A1 * | 3/2007 | Iisaka | 345/96 |

FOREIGN PATENT DOCUMENTS

| | | |
|---|---|---|
| JP | A 09-120054 | 5/1997 |
| JP | A 10-104300 | 4/1998 |
| JP | A 10-333117 | 12/1998 |
| JP | A-2000-075263 | 3/2000 |
| JP | A 2001-222621 | 8/2001 |
| JP | A-2001-306041 | 11/2001 |
| JP | Y2-2607719 | 1/2002 |
| JP | A-2003-173174 | 6/2003 |
| TW | B 406206 | 9/2000 |
| TW | B 418339 | 1/2001 |
| TW | B 491956 | 6/2002 |
| TW | B 494265 | 7/2002 |
| TW | B 505805 | 10/2002 |
| TW | B 515924 | 1/2003 |
| TW | B-546531 | 8/2003 |
| TW | B 546625 | 8/2003 |

* cited by examiner

RELATED ART

METHOD OF DRIVING LIQUID CRYSTAL DISPLAY DEVICE, LIQUID CRYSTAL DISPLAY DEVICE, AND PORTABLE ELECTRONIC APPARATUS

BACKGROUND OF THE INVENTION

1. Field of Invention

The present invention relates to a method of driving a liquid crystal display device, a liquid crystal display device, and a portable electronic apparatus, and more specifically, it relates to a common inversion driving method of a liquid crystal display device using an active matrix substrate.

2. Description of Related Art

Recently, liquid crystal display devices using active elements such as a thin film transistor have been widely used in the fields of a notebook PC or a monitor. In the liquid crystal display device using typical nematic liquid crystal materials, it is necessary to adopt an alternating current driving method in which a polarity of a voltage to be applied to the liquid crystal is inverted for every predetermined time in order to secure reliability. Generally, a difference in voltage to be applied to the liquid crystal for a white display and a black display is in a range of 3 through 5 V. Therefore, in order to implement the alternating current driving method, when the fixed potential are applied to a electrode (common electrode) of a substrate opposing an active matrix substrate with liquid crystal interposed therebetween, a signal having a voltage amplitude of 6 through 10 V should be applied to a pixel electrode on the active matrix substrate. However, since a process of high pressure resistance is required to output a signal having a voltage amplitude of 5 V or more from a typical IC (integrated circuit), a manufacturing cost increases. To avoid this problem, there has been proposed a common inversion driving method in which input signals are decreased by alternating-current driving the potential of the common electrode (see, Patent Document 1).

Now, a 1H common inversion driving method executing a common inversion and a polarity inversion of the voltage applied to the liquid crystal for every scanning line selection cycle (1H cycle) will be described with reference to FIG. 12. Herein, it is supposed that the liquid crystal display device operates, for example, in a normally white mode and has an N-channel thin film transistor as a pixel switching element.

A reference symbol $V_{com}(1)$ denotes a potential of the common electrode, and when an auxiliary capacitor Cs is formed, an auxiliary capacitor common electrode also has the same value. The $V_{com}(1)$ is periodically inverted between potentials $V_{comH}$ and $V_{comL}$ in the case of the common inversion driving method. In addition, a reference symbol $V_{G1\ to\ n}$ (2-1 through 2-n) denotes a potential applied to the nth scanning line from a scanning line driving circuit. For every inversion of the $V_{com}(1)$, a selection potential $V_{GON}$ is sequentially applied to one scanning line for turning on the pixel switching element. At other times, one of the potentials $V_{GOFFH}$ and $V_{GOFFL}$ is selected according to the potential $V_{com}(1)$ and then applied as a non-selection signal for turning off the connected pixel switching element. Herein, the non-selection signal has two different levels $V_{GOFFH}$ and $V_{GOFFL}$ according to the potential $V_{com}(1)$ in order to secure reliability of the pixel switching element. This is disclosed in, for example, Patent Document 2 in detail. A reference symbol $V_{S1\ to\ m}$ (3-1 through 3-m) denotes a video signal potential applied to a data line from a data line driving circuit, and has an amplitude between $V_{VIDEOH}$ and $V_{VIDEOL}$. If the liquid crystal material or the gap is selected such that a white (transparent) display is implemented when the liquid crystal element is interposed between electrodes having a potential difference of $\pm V_{WHITE}$, and a black (non-transparent) display is implemented when the liquid crystal element is interposed between electrodes having a potential difference of $\pm V_{BLACK}$, it is possible to obtain $V_{comH} \geqq V_{VIDEOH} > V_{VIDEOL} \geqq V_{comL}$, and $V_{comH} - V_{VIDEOH} = V_{VIDEOL} - V_{comL} = V_{VWHITE}$, $V_{comH} - V_{VIDEOL} = V_{VIDEOH} - V_{comL} = V_{BLACK}$.

The potential of $V_{S1\ to\ m}$(3-1 through 3-m) is applied to the pixel electrode through the pixel switching element connected to the scanning line having a selection potential $V_{GON}$. Herein, if $V_{PIX4\text{-}1\text{-}1}$ through $V_{PIX4\text{-}n\text{-}m}$ denotes potentials of the pixel electrodes connected between an mth data line and an nth scanning line, $V_{PIX4\text{-}1\text{-}1}$ and $V_{PIX4\text{-}1\text{-}2}$ are charged with the potentials $V_{S1}$ and $V_{S2}$ of the data lines 1 and 2, respectively, and become potentials $V_{VIDEOH}$ and $V_{VIDEOL}$ when the scanning line 1 is the selection potential $V_{GON}$. In this case, the common potential is $V_{comH}$, and to the liquid crystal on the pixel electrode corresponding to $V_{PIX4\text{-}1\text{-}1}$, a potential of $V_{VIDEOH} - V_{comH} = -V_{WHITE}$ is applied.

The potential of $V_{S1\ to\ m}$(3-1 through 3-m) is applied to the pixel electrode through the pixel switching element connected to the scanning line having a selection potential $V_{GON}$. Herein, if $V_{PIX4\text{-}1\text{-}1}$ through $V_{PIX4\text{-}n\text{-}m}$ denotes potentials of the pixel electrodes connected between an mth data line and an nth scanning line, the potentials $V_{PIX4\text{-}1\text{-}1}$ and $V_{PIX4\text{-}1\text{-}2}$ are charged with the potentials $V_{S1}$ and $V_{S2}$ of the data lines 1 and 2, respectively, and become potentials $V_{VIDEOH}$ and $V_{VIDEOL}$ when the scanning line 1 is the selection potential $V_{GON}$. In this case, the common potential is $V_{comH}$, and to the liquid crystal on the pixel electrode corresponding to $V_{PIX4\text{-}1\text{-}2}$, a potential of $V_{VIDEOL} - V_{comH} = -V_{BLACK}$ is applied. In other words, the pixel corresponding to $V_{PIX4\text{-}1\text{-}1}$ is subjected to a transparent (white) display, and the pixel corresponding to $V_{PIX4\text{-}1\text{-}2}$ is subjected to a non-transparent (black) display.

Subsequently, the common potential is inverted to $V_{comL}$ when the scanning line 2 is selected, the pixel electrodes corresponding to $V_{PIX4\text{-}1\text{-}1}$ and $V_{PIX4\text{-}1\text{-}2}$, respectively, are in the floating state because the switching electrode is a high resistance state. Therefore, supposing that capacitive elements except for the common electrode and the capacitor line are negligible, the potentials $V_{PIX4\text{-}1\text{-}1}$ and $V_{PIX4\text{-}1\text{-}2}$ are simultaneously dropped by the amount of change of the potential ($V_{comL} - V_{comH}$) of the common electrode due to the capacitive coupling. As a result, the pixel corresponding to $V_{PIX4\text{-}1\text{-}1}$ maintains the transparent (white) display, and the pixel corresponding to $V_{PIX4\text{-}1\text{-}2}$ maintains the non-transparent display (black). As described above, even though the common potential is repeatedly inverted, the potential difference from the pixel electrode connected to the scanning line of the non-selection potential is not altered. Therefore, the same grayscale display can be maintained until the next scanning line becomes the selection potential.

On the other hand, $V_{PIX4\text{-}2\text{-}1}$ and $V_{PIX4\text{-}2\text{-}2}$ are charged with the potentials $V_{S1}$ and $V_{S2}$ of the data lines 1 and 2 when the scanning line 2 is the selection potential ($V_{GON}$), and become potentials $V_{VIDEOL}$ and $V_{VIDEOH}$, respectively. In this case, a potential of $V_{VIDEOL} - V_{comL} = V_{WHITE}$ is applied to the liquid crystal on the pixel electrode corresponding to the $V_{PIX4\text{-}2\text{-}1}$ and a potential of $V_{VIDEOH} - V_{comL} = V_{BLACK}$ is applied to the liquid crystal on the pixel electrode corresponding to the $V_{PIX4\text{-}2\text{-}2}$, so that a transparent (white) display and a non-transparent (black) display are implemented, respectively. However, they have voltage polarities opposite to those of the pixels corresponding to $V_{PIX4\text{-}1\text{-}1}$ and $V_{PIX4\text{-}1\text{-}2}$. Similarly to the above description, though the common potential is inverted after the scanning line 2 becomes a non-selection potential, the potential difference between the common potential and the pixel potential is not altered, so that the display is retained. When the scanning line becomes the selection potential again in the next frame after the rewriting time according to a refresh rate, the common potential is $V_{comL}$ if the scanning line 1 becomes the selection potential $V_{GON}$, and the common potential is $V_{comH}$ if the scanning line 2 becomes the selection potential $V_{GON}$. Moreover, a polarity of the potential across the liquid crystal element is inverted with respect to the previous frame. Therefore, an alternate driving of the liquid crystal can be implemented. Until now, the conventional 1H common inversion driving method has been described.

According to this method, the amplitude of the input video signal from an external IC is 3 through 5 V. Therefore, it is possible to use a commercial IC made by typical CMOS processes, a manufacturing cost can be reduced. This is the same because an IC for outputting video signals is necessary in the case of an analog driving method in which video analog signals are inputted, even when driving circuits of the active matrix substrate are provided externally, as well as when the driving circuits are embedded in the active matrix substrate, and a power source IC for supplying DC power source to a DAC or a decoder is necessary in the case of a digital driving method in which the DAC or the decoder is embedded. In addition, the common inversion driving method is an effective method even in the case of a power source and driving circuit embedded LCD in which the power generating circuit is embedded in the active matrix substrate, since the circuit size and the current consumption increase and the reliability of the thin film transistor is badly influenced as the voltage range of the generated power source becomes wider, [Patent Document 1] Japanese Unexamined Patent Application Publication No. 62-49399 [Patent Document 2] Japanese Unexamined Patent Application Publication No. 2001-306041

SUMMARY OF THE INVENTION

However, the common inversion driving method has a problem in that it cannot be applied to the panels having a much larger size or a higher definition. In other words, since an electrical capacitance C and a resistance R of the common electrode also increase as the size and the definition of the panel increase, a capacitive delay (RC delay) for inverting the common potential becomes higher, so that it takes more time to invert the common potential. Furthermore, since the current flowing during the common inversion also increases, the current consumption increases.

In order to solve the above problems, the present invention proposes to reduce the common capacitance by electrically insulating, that is, floating at least a part of the scanning lines from the respective potential power sources with a high resistance while the common potential is inverted, that is, a common inversion timing. According to inventor's calculations, assuming data lines are floated during the common inversion timing, 80% or more of the capacitance of the common electrode is a capacitance associated with the scanning lines in the conventional common inversion driving method. Therefore, it is preferable to float as many scanning lines as possible. Most preferably, all the scanning lines are floated. In this case, an inversion time of the common potential is reduced by 20% in comparison with the conventional method. However, depending on driving environments as described below, although only a particular scanning line is not floated, for example, if 479 of 480 scanning lines are floated, a capacitance difference is below 1% in comparison with a case where all the scanning lines are floated. Therefore, there would be no influence. Consequently, even when the number of scanning lines increases and a size of the device becomes larger, a 1H common inversion driving method or other common inversion can be implemented and power consumption can be reduced by floating the scanning lines.

In addition, the present invention proposes to select a period when the common potential is high as the timing for floating the scanning lines if the pixel transistor is an N channel type. According to this proposal, it is possible to turn off a pixel TFT surely and to reduce the number of potentials applied to the scanning line driving circuit without converting a non-selection potential of the scanning line by the common potential like the conventional method and decreasing the non-selection potential so as not to degrade reliability, and with no the potentials of the scanning line exceeding a lowest potential of the video signals of sources other than the selection period. Therefore, it is possible to reduce the manufacturing cost and improve reliability without degrading display quality of panels. If the pixel transistor is a P channel type, similar effects can be obtained by selecting a period when the common potential is low, that is, the timing at which the potential becomes high after the next common potential inversion and floating the scanning lines. If a complementary transmission gate is used for the pixel switching element, similar effects can be obtained by floating the scanning lines connected to the N channel type transistor of the transmission gate when the common potential is high, and floating the scanning lines connected to the P channel type transistor when the common potential is low.

In addition, the present invention proposes a driving method of making time lengths between starting to apply the non-selection potential to the scanning lines and floating the scanning lines in inconstant and plural, after completing a pixel writing. According to this proposal, it is possible to select the timing for floating the scanning lines based on high and low levels of the common potential as described above with the scanning line selection period fixed and without degrading display quality.

In addition, the present invention proposes a driving method in which writing for connected pixels is completed by applying selection potentials to the scanning lines, the non-selection potentials are applied to the scanning lines to turn off the pixel switching elements, and then the non-selection potentials are applied one or more times after the scanning lines are floated at an appropriate timing and before the selection potential is applied to the next scanning line. According to this proposal, it is possible to prevent the connected pixel switching elements from turning on at an unexpected timing due to an increase of the scanning line potential caused by leakage currents during an image hold time. In addition, the present invention also proposes that a period for applying the non-selection potentials after the second one is limited within a period when the common potential is high if the pixel switching element is an N channel type transistor and within a period when the common potential is low if the pixel switching element is a P channel type transistor. According to this proposal, it is possible to remove necessity to change the applied potential in the non-selection period and to reduce the number of power source potentials connected to the scanning line driving circuit. Therefore, the present invention is advantageous from the viewpoint of the manufacturing cost and reliability.

In addition, the present invention proposes to differentiate a period when the common potential is high and a period when the common potential is low during the common inversion, to make a period when the common potential is high longer than a period when the common potential is low if the pixel switching element is an N channel type thin film transistor, and to make a period when the common potential is low longer than a period when the common potential is high if the pixel switching element is a P channel type thin film transistor. According to this proposal, it is possible to select the timing for floating the scanning line with the fixed scanning line selection and non-selection periods or with variations of a narrow range according to high and low levels of the common potential, and to simplify the configuration of the driving circuit without degrading display quality.

In addition, the present invention proposes to maintain the scanning line to the non-selection potential of a constant level $V_{GOFF}$ without depending on the common potential. According to this proposal, it is possible to reduce the number of power sources connected to the scanning line driving circuit, and to simplify the configuration of the driving circuit. Also, it is possible to drive the potential of the scanning line such that the pixel switch is completely turned off by selecting the timing for floating the scanning line.

In addition, the present invention proposes to satisfy a condition of $V_{VIDEOL}+V_{th}>V_{GOFF}>V_{VIDEOL}-(V_{COMH}-V_{COML})$ if the pixel switching element is an N channe type field effect transistor, where a reference symbol $V_{VIDEOL}$ denotes a minimum potential of the video signals applied by the data line driving circuit, a reference symbol $V_{th}$ denotes a threshold value of the pixel switching element, a reference symbol $V_{COMH}$ denotes a high level of the common electrode potential, and a reference symbol $V_{COML}$ denotes a low level of the common electrode potential. By satisfying $V_{VIDEOL}+V_{th}>V_{GOFF}$, it is possible to continuously turn off the pixel switching element even when the video signal is at a minimum potential level. Furthermore, by satisfying $V_{GOFF}>V_{VIDEOL}-(V_{COMH}-V_{COML})$, it is possible to correspondingly reduce a reverse bias for the pixel switching element and to assist to improve reliability or reduce leakage currents. Meanwhile, since the timing for floating the scanning line is selected, the scanning line potential does not exceed a potential level $V_{VIDEOL}$ during the common inversion and the display quality is not degraded. More preferably, in consideration of unevenness in threshold value of the pixel switching elements and a leakage current in the sub-threshold region or a reverse bias, it is preferable to set $V_{VIDEOL}\geqq V_{GOFF}\geqq V_{VIDEOH}-6$ (Volt).

Similarly, if the pixel switching element is a P channel type field effect transistor, it may be proposed setting $V_{VIDEOH}+V_{th}>V_{GOFF}>V_{VIDEOL}-(V_{COMH}-V_{COML})$, and more preferably, $V_{VIDEOH}\leqq V_{GOFF}\leqq V_{VIDEOL}+6$ (Volt).

In addition, the present invention proposes a driving method in which a period when the non-selection potential is applied to the scanning line has a constant length, the non-selection potential ($=V_{GOFFH}$) in the common high state is different from the non-selection potential ($=V_{GOFFL}$) in the common low state, and they satisfy $V_{GOFFH}>V_{GOFFL}$.

In comparison with the above proposal in which the non-selection potential is constantly maintained, this proposal has a problem in that the number of power sources increases. Meanwhile, the driving circuit can be simplified by constantly maintaining the length of the period when the non-selection potential is applied.

Moreover, the present invention proposes a driving method, in which the scanning lines and part of the data lines, more preferably, all of the data lines are floated during the common potential inversion. According to this proposal, it is possible to significantly reduce the capacitance of the common electrode, thereby further allowing effects of the present invention remarkable.

In addition, the present invention proposes a liquid crystal display device using the above driving methods. By using the above driving methods, since an IC of low pressure resistance can be used even in panels having a big size and a high definition, a low-priced apparatus can be provided. Furthermore, the current consumption can be reduced in comparison with the conventional driving method.

In addition, the present invention proposes a driving circuit embedded liquid crystal display device consisting of a thin film transistor in which at least part of the scanning line driving circuits is formed on the active matrix substrate. According to this proposal, since wirings of the scanning lines from the pixel unit to the scanning line driving circuit is made to be shorter, it is possible to prevent a phenomenon that variations of the scanning line potentials is getting smaller than variations of the common potentials due to a capacitance division in this area. At the same time, it is possible to modify a driving method according the above proposals without changing the configuration of external IC.

As described above, the present invention may be more effective as the number of scanning lines increases and a panel size increases. Specifically, the present invention proposes to satisfy a condition that a value obtained by multiplying a square of the number (=V) of scanning lines by a diagonal length (=S(m)) of an image display area (=V×V×S) is 30000 or more.

In addition, the present invention proposes a battery-driven portable electronic apparatus comprising a liquid crystal display device using the above driving methods. According to this proposal, it is possible to provide a display device having a larger size and a higher definition and to reduce current consumption in comparison with prior arts. Therefore, a battery driving time is lengthened. Herein, the portable electronic apparatus includes a notebook PC, a PDA, a digital camera, a video camera, a portable television, a cellular phone, a portable photo viewer, a portable video player, a portable DVD player, a portable audio player, and other electronic apparatuses having a liquid crystal display device and a battery.

DETAILED DESCRIPTION OF PREFERRED EMBODIMENTS

Now, preferred embodiments of the present invention will be described with reference to the attached drawings.

First Embodiment

Figure 1:
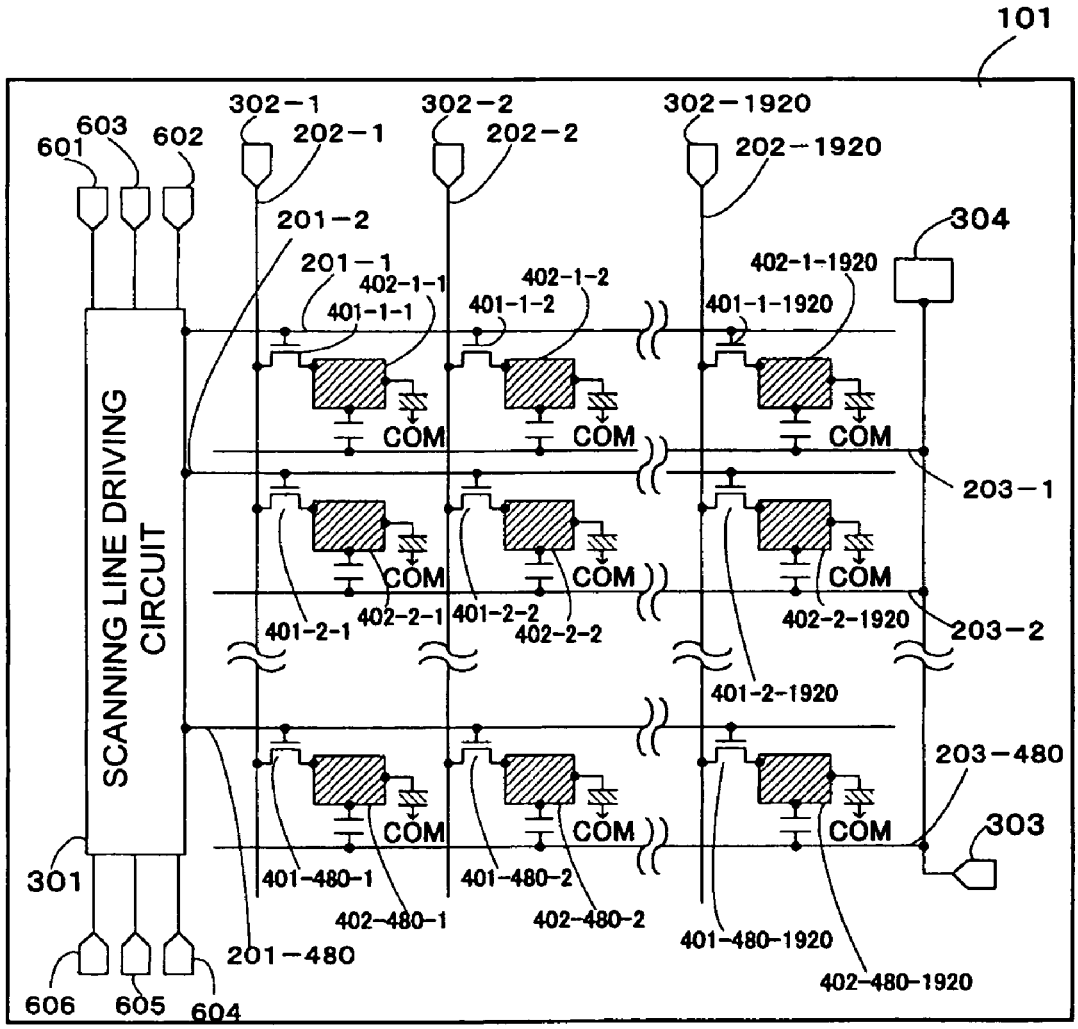
FIG. 1 is a constructural view of an active matrix substrate for explaining embodiments of the present invention.

FIG. 1 is a constructural view of a scanning line driving circuit embedded active matrix substrate according to the first embodiment of the present invention for implementing a driving method associated with the claims 1, 2, 5, 6, 7, 9, 10, 13 and 16. 480 scanning lines 201-1 through 480 and 1920 data lines 202-1 through 1920 are orthogonally formed on the active matrix substrate 101, and the 480 capacitor lines 203-1 through 480 are alternately paralleled with the scanning lines 201-1 through 480. The data lines 202-1 through 1920 are connected to the data line input terminals 302-1 through 1920. The capacitor lines 203-1 through 480 are shorted with each other and connected to the common potential input terminal 303. An opposing conducting unit 304 is also connected to the common potential input terminal 303.

In each intersection point of the scanning line 201-n and the data line 202-m, a pixel switching element 401-n-m consisting of an N channel field effect thin film transistor is formed, and its gate electrode is connected to the scanning line 201-n, and its source and drain electrodes are connected to the data line 202-m and the pixel electrode 402-n-m, respectively. The pixel electrode 402-n-m forms an auxiliary capacitor along with the capacitor line 203-n, and also forms a capacitor along with the opposing substrate electrode COM with the liquid crystal element interposed therebetween when assembled in the liquid crystal display device.

The scanning lines 201-1 through 480 are connected to the scanning line driving circuit 301 formed by integrating a poly silicon thin film transistor on the active matrix substrate to apply driving signals. A CLK signal terminal 601, a CLKX signal terminal 602, an XST signal terminal 603, an HENB terminal 604, an LENB terminal 605, an LCHG terminal 606 are connected to the scanning line driving circuit 301. Additionally, a plurality of power potentials are connected to the scanning line driving circuit although it is not shown in the drawings.

Figure 2:
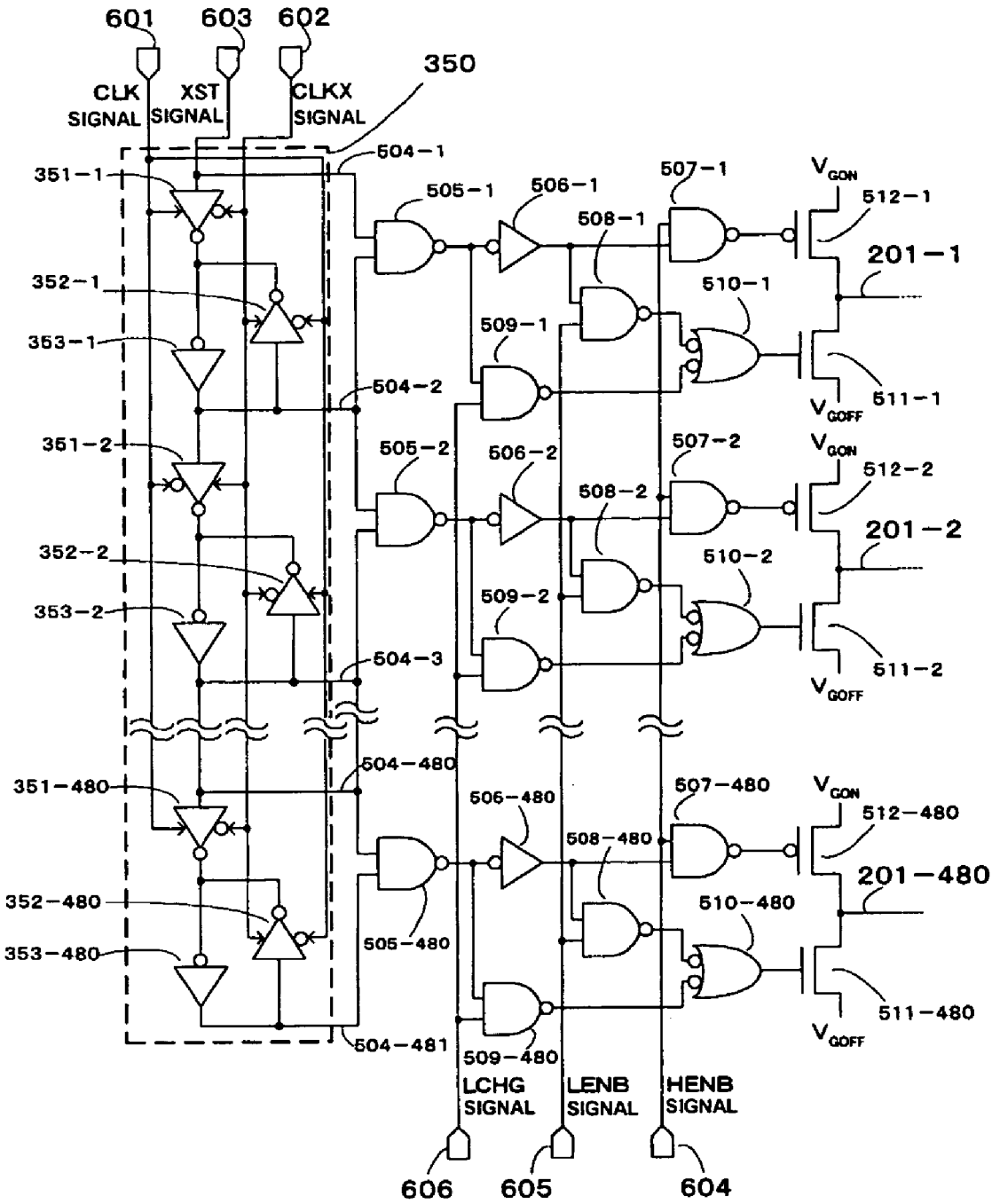
FIG. 2 is a circuit diagram of a scanning line driving circuit for explaining the embodiments of the present invention.

FIG. 2 is a detailed circuit diagram showing a scanning line driving circuit 301. In the scanning line driving circuit 301, a shift register circuit 350 is integrated, and the CLK signal terminal 601, a CLKX signal terminal 602, and an XST signal terminal 603 are connected to it. In the shift register, 480 stages are formed by combining a first clocked inverter 351-n, a second clocked inverted 352-n, and a first inverter 353-n as one stage, and 481 output terminals 504-1 through 481 are formed from an initial stage to the last one.

An nth output terminal 540-n and an (n+1)th output terminal 540-n+1 of the shift register circuit 350 are connected to an input terminal of a first NAND circuit 505-n, and an output terminal of the first NAND circuit 505-n is connected to an input terminal of a second inverter 506-n and one side of input terminals of a fourth NAND circuit 509-n. An output terminal of a second inverter 506-n is connected to one side of input terminals of a second NAND circuit 507-n and one side of input terminals of a third NAND circuit 508-n. Additionally, an HENB signal terminal 604 is connected to the other side of the input terminals of the second NAND circuit 507-n, an LENB signal 605 is connected to the other side of the input terminals of the third NAND circuit 508-n, and an LCHG signal terminal 606 is connected to the other side of the input terminals of the fourth NAND circuit 509-n. Furthermore, the output terminal of the third NAND circuit 508-n and the output terminal of the fourth NAND circuit 509-n are connected to an input terminal of a fifth NAND circuit 510-n. The output terminal of the second NAND circuit 507-n is connected to a gate terminal of a second transistor 512-n corresponding to a P channel type thin film transistor, and an output terminal of the fifth NAND circuit 510-n is connected to a gate terminal of a first transistor 511-n corresponding to an N channel type thin film transistor.

A source terminal of the first transistor 511-n is connected to a power potential of $V_{GOFF}$, and a source terminal of the second transistor 512-n is connected to a power potential of $V_{GON}$. In addition, a drain terminal of the first transistor 511-n and a drain terminal of the second transistor 512-n are connected to the scanning line 201-n. Although it is not shown in the drawing, the first clocked inverter 351-n, the second clocked inverter 352-n, the first inverter 353-n, the first NAND circuit 505-n, the second inverter 506-n, the third NAND circuit 508-n, the fourth NAND circuit 509-n, and the fifth NAND circuit 510-n are connected to a VH potential terminal and a VL potential terminal as a power source.

Figure 3:
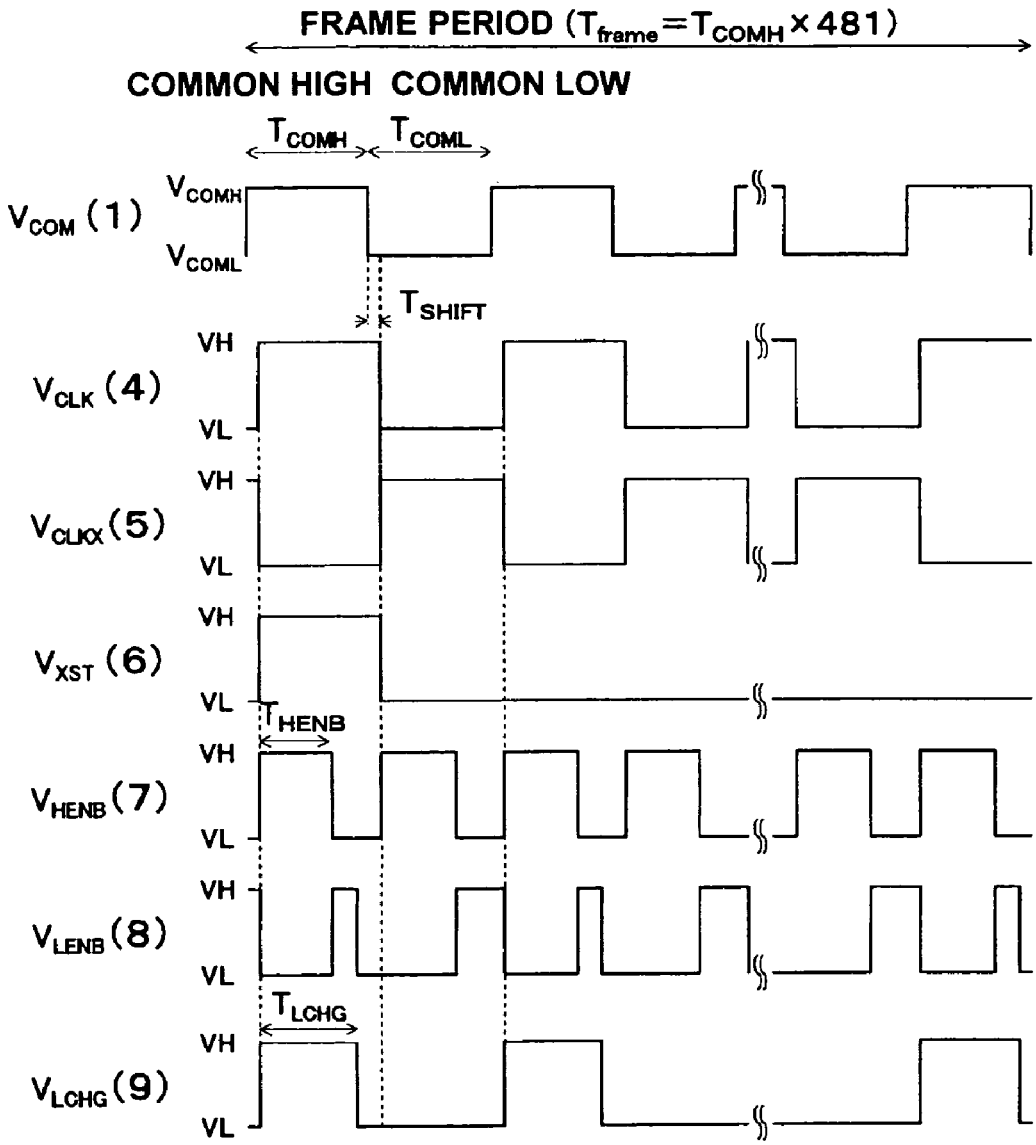
FIG. 3 is a timing chart of each driving signal to be applied from an external signaling system in an odd-numbered frame according to a first embodiment.
Figure 4:
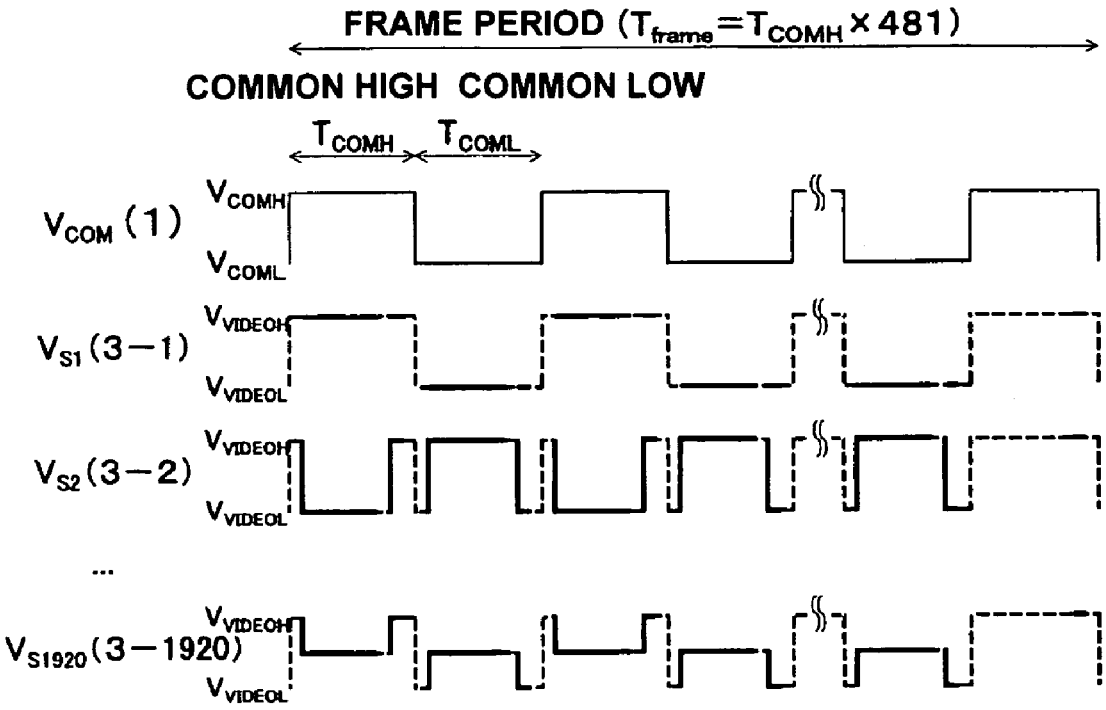
FIG. 4 is a timing chart of video signals to be applied from an external signaling system in an odd-numbered frame according to the first embodiment and a third embodiment.
Figure 5:
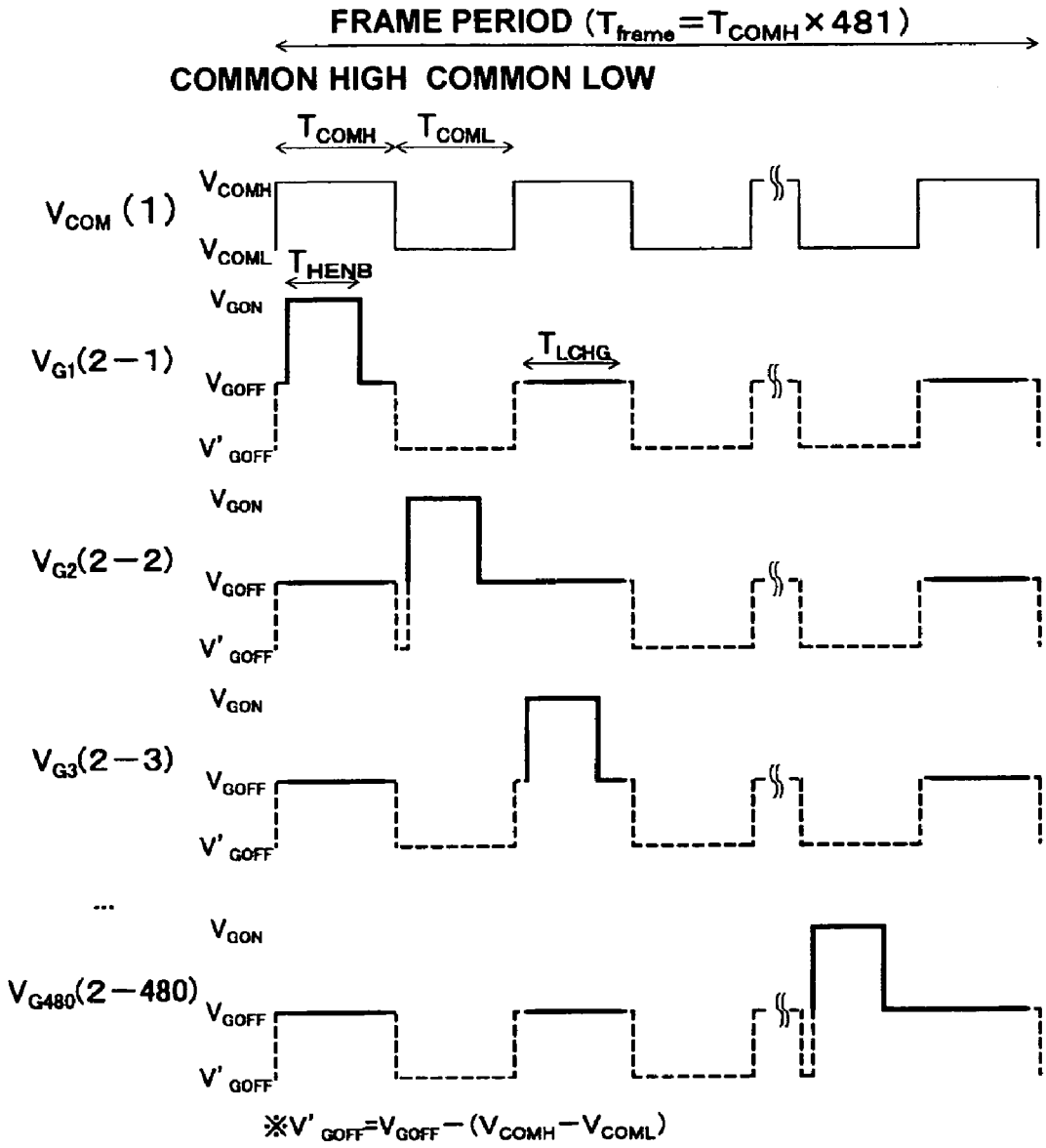
FIG. 5 is an output timing chart of scanning line signals in an odd-numbered frame according to the first embodiment.

Now, the driving method according to the first embodiment will be described in detail with reference to FIGS. 3, 4 and 5. FIGS. 3, 4, and 5 are associated with an odd-numbered frame. In the case of an even-numbered frame, since a frame is initiated in a common low state and also terminated in the common low state, the potential of the common electrode is inverted when a selection potential is applied to each scanning line.

FIG. 3 is a timing chart of each signal applied from an external signaling source in the case of the odd-numbered frame according to the first embodiment. A reference symbol $V_{COM}(1)$ denotes a potential applied to a common potential input terminal 303, and is periodically inverted between potentials $V_{COMH}$ and $V_{COML}$. A hold time $T_{COMH}$ of the potential $V_{COMH}$ (hereinafter, referred to as a common high state) is equal to a hold time $T_{COML}$ of the potential $V_{COML}$ (hereinafter, referred to as a common low state) and one frame period $T_{frame}$ is obtained by multiplying 481 by the hold time $T_{COMH}$. A reference symbol $V_{CLK}(4)$ denotes a positive phase clock signal potential applied to the CLK signal terminal 601 for driving a shift register, and a signal inverted between the potentials VH and VL with a phase shifted by $T_{SHIFT}$ in an equal inverting cycle to the potential $V_{COM}(1)$. A reference symbol $V_{CLKX}(5)$ denotes a reverse phased clock signal potential input to the CLKX signal terminal 602 for driving the shift register, and has a polarity opposite to the potential $V_{CLK}$. A reference symbol $V_{XST}(6)$ denotes an input potential of an initial stage bit of the shift register, which is inputted to the XST signal terminal 603, and corresponds to a pulse wave having a pulse length of $T_{COMH}$ and a cycle of $T_{frame}$.

A reference symbol $V_{HENB}(7)$ denotes a potential signifying the timing for applying a selection potential input to the HENB signal terminal 604 to a scanning line selected by the shift register. The potential $V_{HENB}(7)$ is simultaneously turned to the potential VH when the potential $V_{CLK}(4)$ is inverted and returned to the potential VL after a predetermined period $T_{HENB}<T_{COMH}$.

A reference symbol $V_{LENB}(8)$ denotes a potential signifying the timing for applying a non-selection signal input to the LENB signal terminal 605 to a scanning line selected by the shift register. The potential $V_{LENB}(8)$ is substantially simultaneously turned to the VH when the potential $V_{HENB}(7)$ is turned to the VL, and then returned to the VL before the potential $V_{com}(1)$is inverted during the common high state or substantially simultaneously returned to the VL when the potential $V_{CLK}$ is inverted after the potential $V_{com}(1)$ is inverted during the common low state.

A potential $V_{LCHG}(9)$ provides a non-selection signal input to the LCHG signal terminal 606 with the scanning lines except for those selected by the shift register. In other words, the potential $V_{LCHG}(9)$ signifies the timing for recharging the scanning lines by $V_{GOFF}$, and is turned to the VH of a constant period ($T_{LCHG}<T_{COMH}$) during the common high state, or turned to the VL otherwise.

FIG. 4 is a timing chart showing video signals applied from an external driving circuit in an odd-numbered frame according to the first embodiment. The solid line denotes a state that a potential is applied from an external power source, and the dotted line denotes a floating state that the external power sources are blocked with each other by a high resistance. Hereinafter, the description will be given on a basis of a normally white mode.

A reference symbol $V_{S1\ to\ 1920}$(3-1 through 1920) denotes a video signal potential input to the data line input terminals 302-1 through 1920 within the range between a highest potential $V_{VIDEOH}$ and a lowest potential $V_{VIDEOL}$, and their detailed waveforms are different depending on an image to be displayed. In this embodiment, waveforms of the potentials $V_{S1}$, $V_{S2}$ and $V_{S1920}$ are illustrated such that pixels connected to the data line 201-1 are subjected to a white (transparent) display, pixels connected to the data line 202-2 are subjected to a black (non-transparent) display, pixels connected the data line 202-1920 are subjected to a gray (semi-transparent) display, and the potentials $V_{S1}$, $V_{S2}$ and $V_{S1920}$ are floated during the common inversion timing after completing charging the pixel electrode, turning off the pixel switching element, and inputting a white level signal as a pre-charge signal. However the output initiation and stop timing or the pre-charge timing of the video signal of the potential $V_{S1\ to\ 1920}$(3-1 through 1920) is different depending on driving methods such as a point sequential driving method, a line sequential driving method, and a block sequential driving method, the data line should be in the floating state during the common inversion timing in any cases. This embodiment is based on a line sequential driving method.

FIG. 5 is a timing chart showing output signals applied from the scanning line driving circuit 301 to the scanning lines 201-1 through 480 in an odd-numbered frame according to the first embodiment. The solid line denotes a state that a potential is applied from an external power source, and the dotted line denotes a floating state that the external power sources are blocked with a high resistance. The shift register 350 sequentially outputs the VH to only a particular output terminal 504-n and its neighboring output terminal 504-n+1. The terminals outputting the VH are shifted one by one every when the CLK signal corresponding to $V_{CLK}(4)$ and the CLKX signal corresponding to $V_{CLKX}(5)$ are inverted. As a consequence, potentials $V_{G1\ to\ n}$(2-1 through 2-480) are finally applied to the scanning lines. In other words, similarly to the scanning lines 1, 3, 5, . . . (2-1, 2-3, 2-5, . . . ) in an odd-numbered frame, the scanning lines to which the selection potential $V_{GON}$ is applied while the common high state are turned to a floating state during the common high state. Similarly to the scanning lines 2, 4, 6, . . . (2-2, 2-4, 2-6, . . . ) in an odd-numbered frame, the scanning lines to which the selection potential $V_{GON}$ is applied while the common low state are not turned to the floating state until the $V_{COM}(1)$ is inverted and then the $V_{CLK}(4)$ is inverted after $T_{SHIFT}$. In other words, the timing for turning to the floating state is modified by changing a time for writing the non-selection signal. Additionally, the non-selection potential is written to those except the selected scanning lines for a time period $T_{LCHG}$ during the common high state. However, they are in the floating state before and after the inversion timing of the common high state and the common low state. Furthermore, although it is not shown in the drawing, in an even-numbered frame, the common potential is inverted when the selection potential $V_{GON}$ is applied to the same scanning lines as the odd-numbered frame, and the alternate driving of the liquid crystal is implemented. Consequently, the reliability of the liquid crystal can be secured.

In the present embodiment, each power potential is preferably set to $VH \geqq V_{GON} > V_{VIDEOH} > V_{VIDEOL} > V_{GOFF} \geqq VL$ and $V_{comH} \geqq V_{VIDEOH} > V_{VIDEOL} \geqq V_{comL}$addition, the potential $V_{COMH}-V_{VIDEOH}=V_{WHITE}$ is preferably set to a white (transparent) display potential in a normally white mode in association with the adopted liquid crystal element and the cell gap, and the potential $V_{VIDEOH}-V_{COML}=V_{BLACK}$ is preferably set to a black (non-transparent) display potential in a normally white mode.

As described in the present embodiment, if a poly silicon thin film transistor is used as the pixel switching element, deviations of a threshold value are large, and leakage currents in a sub-threshold region or a reverse bias region are not negligible. If the refresh rate of the screen is below 60 Hz and the leakage currents are over 1 pA, a large capacitance is necessary, and an aperture ratio decreases so as to degrade display quality.

Figure 13:
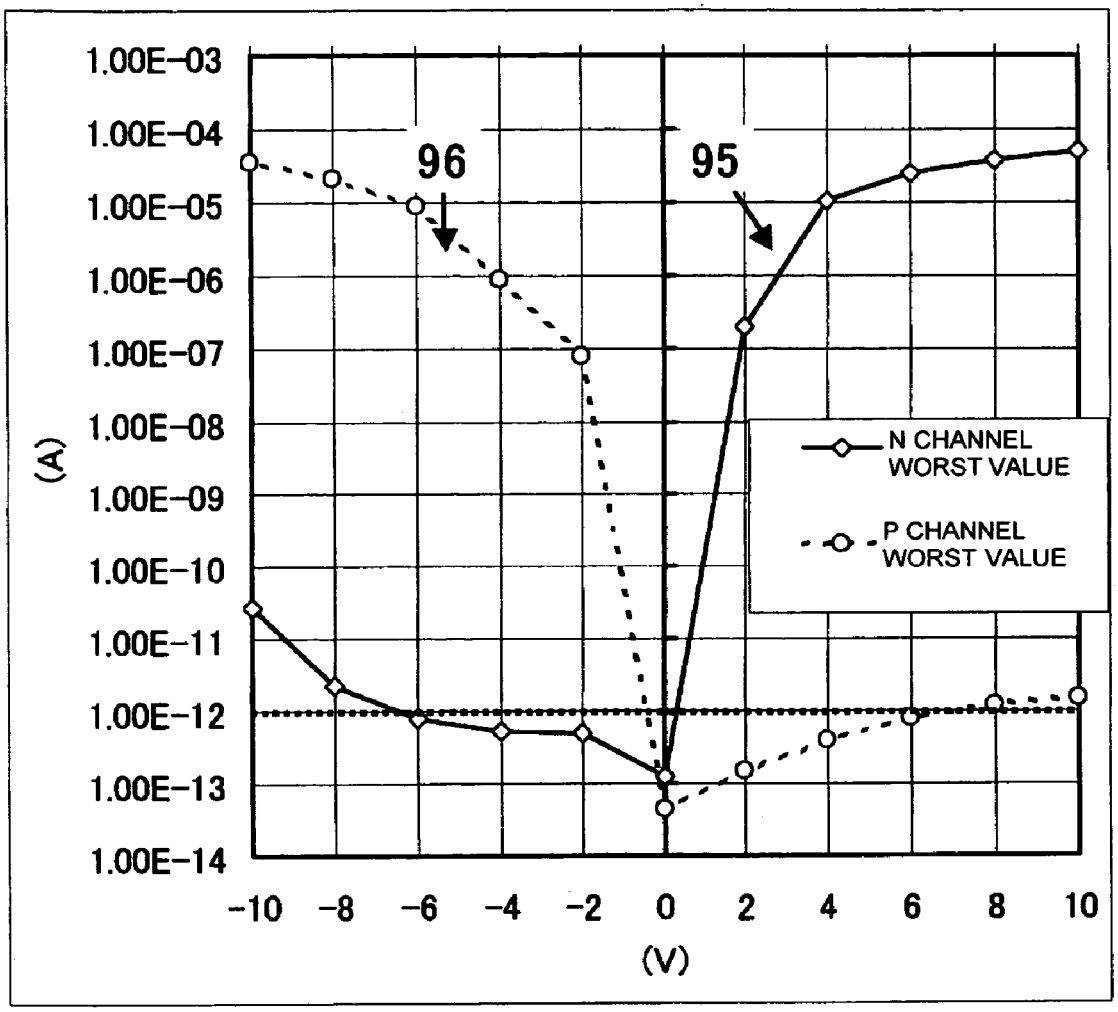
FIG. 13 is a graph of a measurement result of leakage currents of pixel switching elements of an N channel type thin film transistor and a P channel type thin film transistor.

FIG. 13 is an inventor's graph showing the leakage currents of a pixel switching element using a poly silicon thin film transistor. The horizontal axis refers to a gate-source potential V, and the vertical axis refers to a source-drain leakage current A, which corresponds to the maximum value of the measurement in a variety of points. The graph 95 relates to data on the N channel transistor, and the graph 96 relates to data on the P channel transistor. If the N channel transistor is used as described in the present embodiment, it is recognized from the graph 95 that the maximum leakage current of the pixel switching element is below 1 pA, and the gate-source potential is within the range of 0 through −6 (V). In a driving method according to the present invention, if the gate potential is $V_{GOFF}$, the gate-source potential is within the range of $V_{GOFF}-V_{VIDEOL}$ through $V_{GOFF}-V_{VIDEOH}$. Therefore, by satisfying $V_{VIDEOL} \geqq V_{GOFF} \geqq V_{VIDEOH}-6$ (V), the gate-source potential is more preferably set to 0 through −6 (V). In addition, since the gate-source potential corresponding to the leakage currents below 1 pA is within the range of 0 through +6 (V) in the graph 96 if the P channel poly silicon thin film transistor is used as the pixel switching element, it is more preferable to satisfy $V_{VIDEOH} \leqq V_{GOFF} \leqq V_{VIDEOL}+6$ (V).

Typically, a central value (an average of high potentials and low potentials) of potentials applied to one circuit or element is preferably equal to an average of the common electrode potential from the viewpoint of influences to the liquid crystal element.

Considering above conditions, and assuming that the liquid crystal material and the bonding gap are selected to have, for example, $V_{WHITE}=0.5$ (V), $V_{BLACK}=4.0$ (V), each potential according to the present invention is preferably set such that VH=8.5 (V), $V_{GON}$=7.5 (V), $V_{COMH}$=6.5 (V), $V_{VIDEOH}$=6 (V), $V_{VIDEOL}$=2.5 (V), $V_{COML}$=2 (V), $V_{Goff}$=1 (V), and VL=0 (V).

By means of such a driving method, all 480 scanning lines are floated when the inversion timing from the common high potential to the common low potential, and 479 scanning lines except for the selected scanning line are floated when the inversion timing from the common low potential to the common high potential. In comparison with a conventional driving method in which the non-selection potential is continuously written to all scanning lines, the current flowing through the common potential input terminal 303 when the common inversion can be very small, thereby rapidly altering the common potential. In other words, it is possible to use the common inversion driving method without degrading display quality even in a large size and a high definition, and to use the low price and low pressure resistance IC as an IC for outputting a video signal.

In addition, since the timing for floating the scanning line is changed between the common high state and the common low state, despite one non-selection potential to the scanning line is used, as shown in FIG. 5 as $V_{G1\ to\ 480}$(2-1 through 480), the potential of the scanning line in the non-selection state is changed in combination with the common potential but does not raise over $V_{GOFF}$. In addition, since the non-selection potential is rewritten in every period $T_{COMH}+T_{COML}$, the potential of the scanning line is not deviated from the non-selection potential during the hold time even when the leakage currents of the first transistor 511-n and the second transistor 512-n in FIG. 2 are large.

In addition, since the potential $V_{GOFF}$ is at a constant level and the power potential is not necessary to be frequently inverted or to select one from two potentials in the common high state as well as the common low state, the circuit configuration is made to be simple, the cost can be reduced, and the yield can be improved. In addition, since the potential $V_{GOFF}$ is set to an appropriate level, the pixel switching element 401-n-m is not turned on during the non-selection period (the hold time) by the source potential even when the common inversion. Furthermore, since a reverse bias for the pixel switching element 401-n-m is prevented as small as possible, it is possible to prevent degradation of reliability and increase of the leakage current of the pixel switching element.

Figure 6:
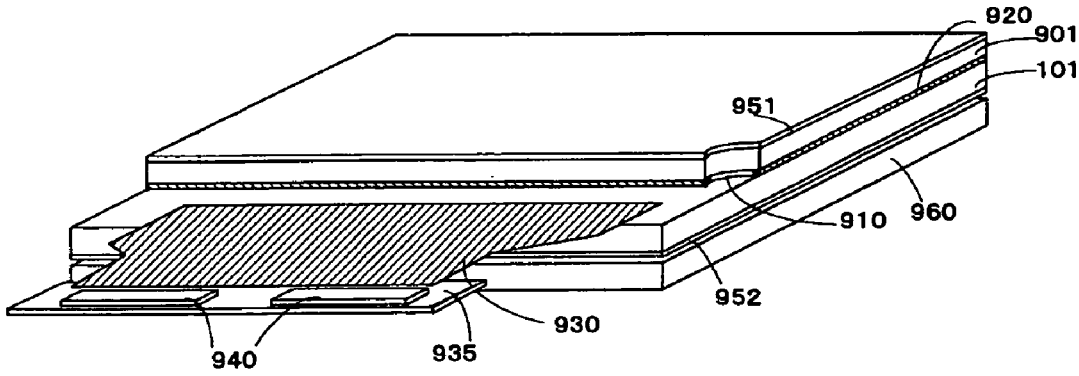
FIG. 6 is a perspective and partial cross-sectional view of a liquid crystal display device according to the embodiments of the present invention.

FIG. 6 is a perspective and partial cross-sectional view of the transmissive liquid crystal display device according to the first embodiment of the present invention for implementing a liquid crystal display device disclosed in claims 17 through 19. The active matrix substrate 101 and the opposing substrate 901 having the common electrode by forming an ITO film on the color filter substrate are bonded with each other by using a sealing material 920 and a nematic phase liquid crystal material 910 is enclosed between them. Although it is not shown in the drawing, an alignment material made of a polyimide is doped on the surface contacting with the liquid crystal material 910 along with the active matrix substrate 101 and the opposing substrate 901, and then a rubbing process is performed in an orthogonal direction. In addition, a conducting material is disposed in the opposing conducting unit 304 on the active matrix substrate 101, and is shorted with the common electrode of the opposing substrate 901.

Data input terminals 302-1 through 1920, a common potential input terminal 303, a CLK signal terminal 601, a CLKX signal terminal 602, a start pulse signal terminal 603, an HENB signal terminal 604, an LENB signal 605, an LCHG signal terminal 606, and a variety of power supply terminals are connected to one or more external IC 940 on the circuit substrate 935 through the FPC 930 integrated in the active matrix substrate 101 to supply necessary electrical signals and potentials.

In addition, an upper deflection plate 951 is disposed in an outer side of the opposing substrate, and a lower deflection plate 952 is disposed in an outer side of the active matrix substrate, such that their deflection directions are orthogonal with each other (crossed nicols state). In addition, a back light unit 960 is attached under the lower deflection plate 952. The back light unit 960 may be formed by attaching an optical waveguide or a dispersion plate on a cold-cathode tube or may be a light emitting unit using an EL element. Although it is not shown in the drawing, its outer surface may be covered with an enclosure, a protection glass or an acrylic plate may be attached on the upper deflection plate as necessary, or an optical compensation film may be attached to improve its view angle.

When a common inversion driving method is implemented by using such a liquid crystal display device, a common potential retardation time constant ($=\tau_{COM}$) is substantially proportional ($\tau_{COM} \propto R_{COM} \times C_{COM}$) to a multiplication of an average resistance ($=R_{COM}$) of the common electrode by a total capacitance ($=C_{COM}$) for other conduction materials connected to a fixed potential. Typically, the resistance $R_{COM}$ is determined by process limitations, such as a sheet resistance of the opposing electrode or resistances of the opposing conducting unit and an integrated terminal, and is not much influenced by a panel size or a definition. Meanwhile, according to a conventional common inversion driving method, since the capacitance associated with the scanning lines is more than 80% as described above, the total capacitance $C_{COM}$ increases in proportion to the total number (=V) of the scanning lines. In addition, since the capacitance per a scanning line increases as the length of the scanning line becomes larger, the total capacitance $C_{COM}$ increases in proportion to the diagonal size (=S(m)) of the image display region. On the other hand, if the refresh rate is constant, a write time ($=T_{1H}$) to one scanning line decreases in proportion to the total number (=V) of scanning lines. In other words, according to the conventional common inversion driving method, a proportion ($\tau_{COM} \div T_{1H}$) of a common inverse time to the writing time to one scanning line substantially reaches to $\tau_{COM} \div T_{1H} \propto V \times V \times S$. If this coefficient is too large, a sufficient pixel writing time can not be obtained, thereby degrading display quality or reliability.

Figure 14:
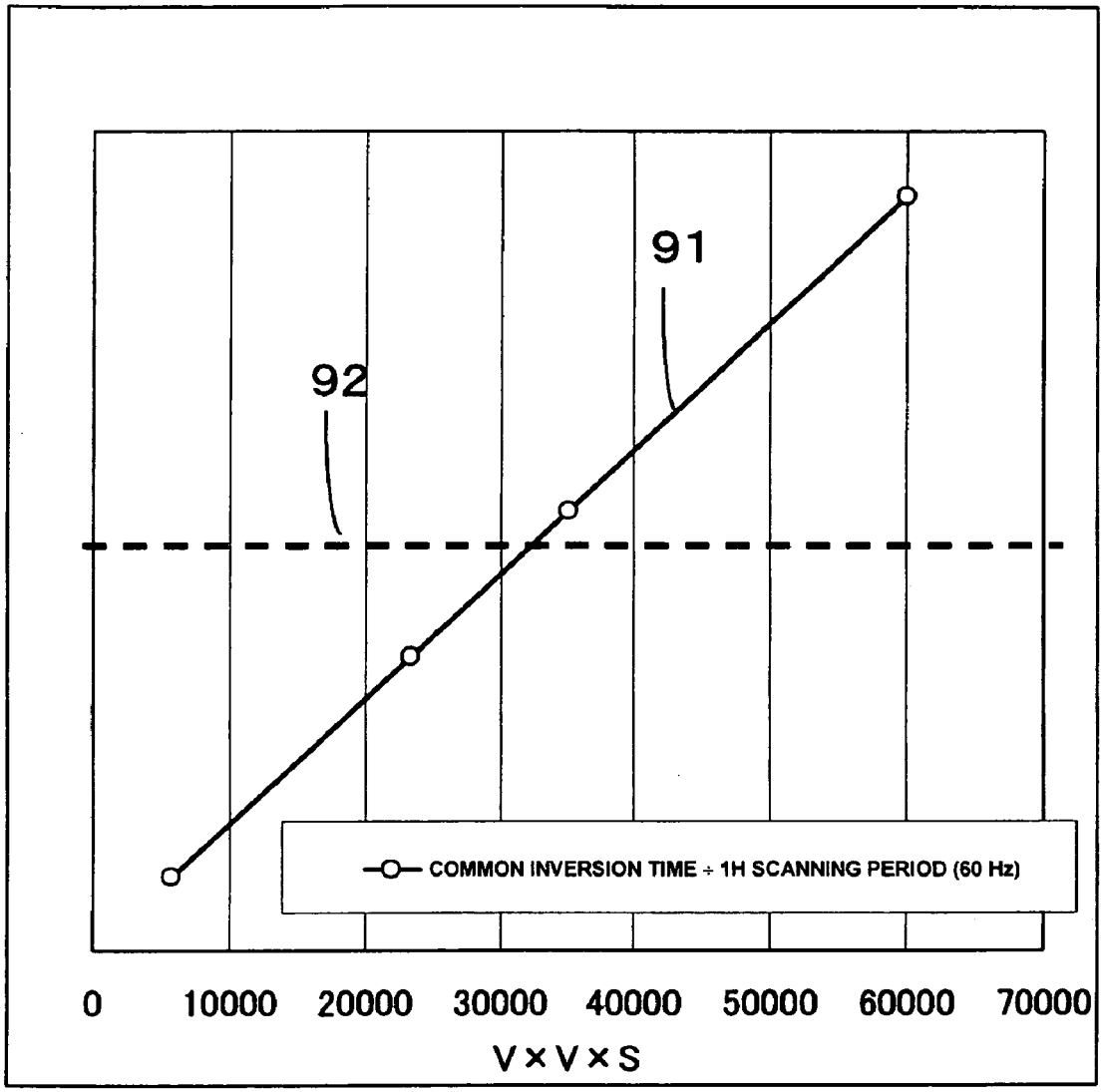
FIG. 14 is a graph for explaining limitations of a size and a definition of a liquid crystal panel which can be driven in a common inversion mode with a conventional method.

FIG. 14 is a graph showing the result of calculation of a coefficient ($=V \times V \times S$) obtained by multiplying a square of the number (=V) of scanning lines by the diagonal size (=S(m)) of the image display area, and a proportion ($\tau_{COM} \div T_{1H}$) of the common inversion time to the 1H time when an active matrix manufacturing process using a typical glass substrate is adopted. In this case, the refresh rate is set to 60 Hz. From the graph 91 showing $\tau_{COM} \div T_{1H}$, it is recognized that the proportion $\tau_{COM} \div T_{1H}$ is substantially proportional to $V \times V \times S$. The line 92 denotes a limitation line obtained from a minimum time necessary to guarantee a sufficient pixel write time. From the graph shown in FIG. 14, it is recognized that the 1H common inversion is difficult to be implemented according to the conventional driving method if $V \times V \times S \geqq 30000$. Therefore, since a low-priced and low pressure resistant IC can be used in a large size and a high definition panels, in which the common inversion driving method of the conventional method can not be implemented, by applying the present invention to the panels satisfying the condition $V \times V \times S \geqq 30000$, the module can be manufactured with lower cost, and power consumption can be reduced. In the present embodiment, if a diagonal is 152.4 mm (6 type) in a so-called VGA having the number of pixels of 1920×480, it is possible to obtain V×V×S=35113, and thus the above condition is satisfied.

In addition, according to the present invention, a period when the $V_{LCHG}$ signal 9 is at a potential VH may be enlarged if the leakage currents of the second transistor 512-1 through 489 are small. Furthermore, the LCHG signal terminal 606, the wirings connected to it, and the fourth NAND circuit 509-n in FIG. 2 may be omitted. Also, the fifth NAND circuit 510-1 may be substituted with an inverter circuit. This can make the input signals and the circuit configuration to be simpler. Therefore, it is possible to manufacture lower cost liquid crystal display device.

In addition, however it has been described by exemplifying the common electrode potential having two levels ($V_{COMH}$, $V_{COML}$), the common electrode potential may have three levels by controlling the amplitude more precisely depending on a driving method. In this case, one of the average potential, the maximum potential, and the minimum potential of the common electrode in the common high state may be substituted with the potential $V_{COMH}$, and one of the average potential, the maximum potential, and the minimum potential of the common electrode in the common low state may be substituted with the potential $V_{COML}$. In addition, the selection potential or the non-selection potential of the gate may have minuter multi levels.

In addition, the shift register may be configured using a flip-flop circuit or a transmission gate, not the clocked inverter shown as the reference numeral 350 in FIG. 2. Furthermore, the shift register may be substituted with a variety of sequential selection circuits, and the logic circuit unit in FIG. 2 may be modified accordingly.

In addition, according to the present embodiment, however the scanning line driving circuit 301 is driven by two potential levels VH($\geqq V_{GON}$)and VL($\leqq V_{GOFF}$), it is possible to use lower potentials with respect to part of them. For example, it is possible to use the potentials VHM($<V_{GON}$) and VLM ($>V_{GOFF}$) as a power source of the shift register unit 350, and to modify the amplitudes of the signals VCLK(4), VCLKX (5), and VXST(6), correspondingly. Furthermore, the level shifter circuit may be installed on any position between the first transistor 511-n and second transistor 512-n from the output terminal 504-n and may perform the boosting up to the level VH through VL. Otherwise, from the shift register 350 or the first NAND circuit, the fifth NAND circuit regarded as it is may be equipped with a level shift function. Such configurations can reduce current consumption.

Second Embodiment

Figure 7:
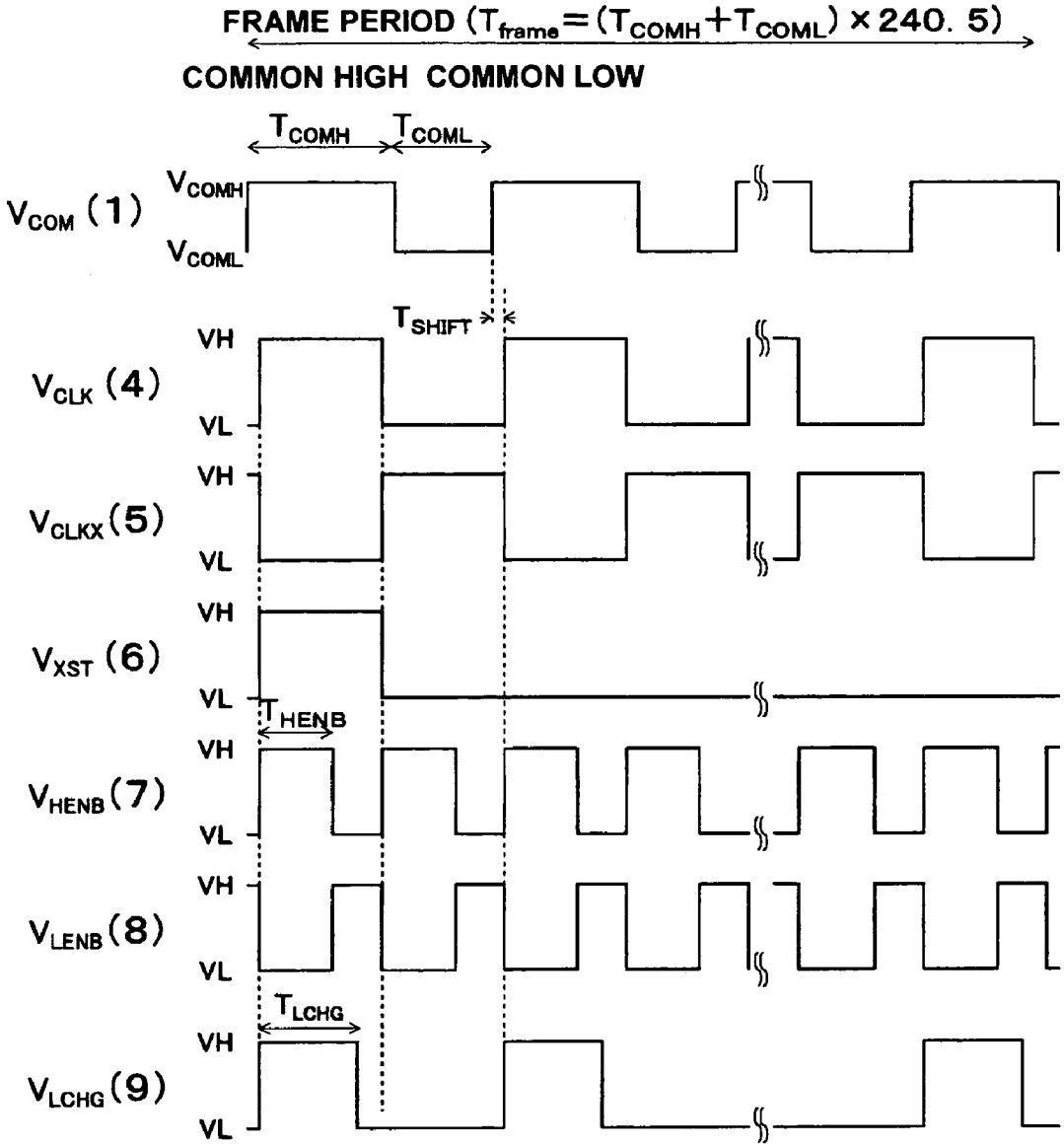
FIG. 7 is a timing chart of each driving signal to be applied from an external signaling system in an odd-numbered frame according to a second embodiment.
Figure 8:
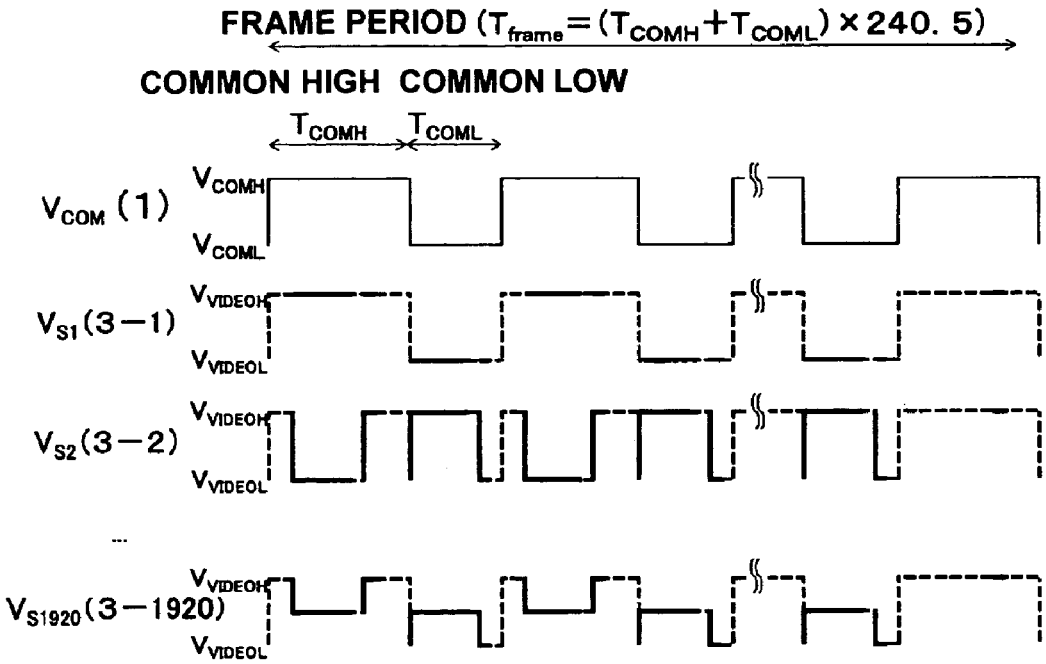
FIG. 8 is a timing chart of video signals to be applied from an external signaling system in an odd-numbered frame according to the second embodiment.
Figure 9:
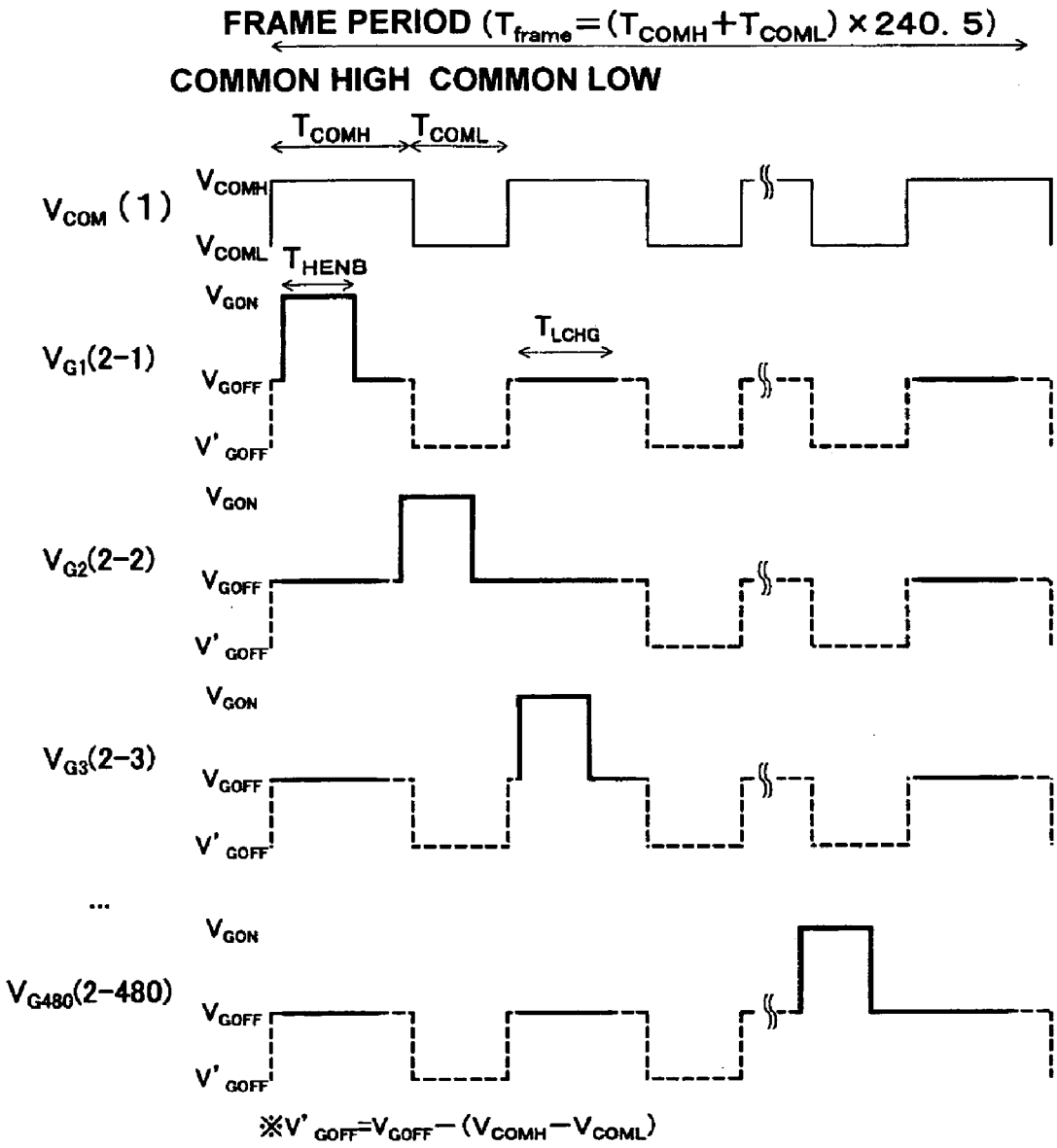
FIG. 9 is an output timing chart of scanning line signals in an odd-numbered frame according to the second embodiment.

FIGS. 7, 8 and 9 are timing charts of signals in an odd-numbered frame according to the second embodiment of the present invention for implementing a driving method disclosed in claims 1, 2, 6, 7, 9, 10, 12, 13 and 16. The solid line denotes a state that a potential is applied from an external source, and the dotted line denotes a floating state that each external power source is blocked with a high resistance.

FIG. 7 is the timing chart of each signal applied from an external signaling source in an odd-numbered frame according to the second embodiment of the present invention. With regard to the $V_{COM}$(1), a relation between the hold time $T_{COMH}$ of the potential $V_{COMH}$ and the hold time $T_{COML}$ of the potential $V_{COML}$ is set to $T_{COMH}>T_{COML}$, and the frame period $T_{frame}$ is set to $(T_{COMH}+T_{COML})\times 240.5$. In other words, with regard to an even-numbered frame, an operation is initiated in the middle of the common high state.

However the potentials $V_{CLK}$(4), $V_{CLKX}$(5), $V_{XST}$(6), $V_{HENB}$(7), and $V_{LCHG}$(9) have waveforms similar to the first embodiment, the potential $V_{LENB}$(8) has the same time length as the VH in the common high period and the common low period, and the potentials $V_{HENB}$(7) and $V_{LENB}$(8) are inverted.

FIG. 8 is the timing chart of video signals applied from an external driving circuit in an odd-numbered frame according to the first embodiment of the present invention. Beside an application time of the video signal to the pixel electrode is reduced in order to float the source line in the common inversion timing, FIG. 8 is similar to FIG. 4 regarding the first embodiment.

FIG. 9 is the timing chart showing output signals applied from the scanning line driving circuit 301 to the scanning lines 201-1 through 480 in an odd-numbered frame according to the second embodiment of the present invention. Signals VG1(2-1), VG3(2-3), and become a common high state in the common inversion timing, and then become a floating state in the common high period when the selection potential $V_{GON}$ is applied after the time $T_{SHIFT}$. However, signals VG2(2-2), VG4(2-4), and . . . become the common inversion timing after the selection potential $V_{GON}$ is applied just before the common inversion timing in the common high state, and then become the common inversion timing again during the non-selection potential is output.

According to the present embodiment, 479 scanning lines except for the one to which the selection potential is applied are in the floating state during the inversion timing from the common high state to the common low state, 479 scanning lines except the one to which the non-selection potential is applied are in the floating state during the inversion timing from the common low state to the common high state. Similarly to the first embodiment, it is possible to use the common inversion driving method without degrading display quality in a liquid crystal display device having a big size and a high definition. Therefore, it is possible to use a low-priced and low pressure resistant IC as an IC for outputting video signals and to reduce power consumption.

In addition, according to the present embodiment, since signals $V_{HENB}$(7) and $V_{LENB}$(8) are inverted with each other, it is possible to supply only one side of them from an external IC and to generate the other side by using an inverter circuit on the active matrix substrate. Therefore, it is possible to reduce the number of input signals and wirings in a simpler manner.

In addition, since a constructural view of the active matrix substrate, a circuit diagram of the scanning line driving circuit, and a constructural view of modules in the liquid crystal display device are similar to those of the first embodiment, the present embodiment will be more easily understood with reference to FIGS. 1, 2 and 6. Moreover, setting-up a variety of power potentials and their functions are also similar to those of the first embodiment.

Third Embodiment

Figure 10:
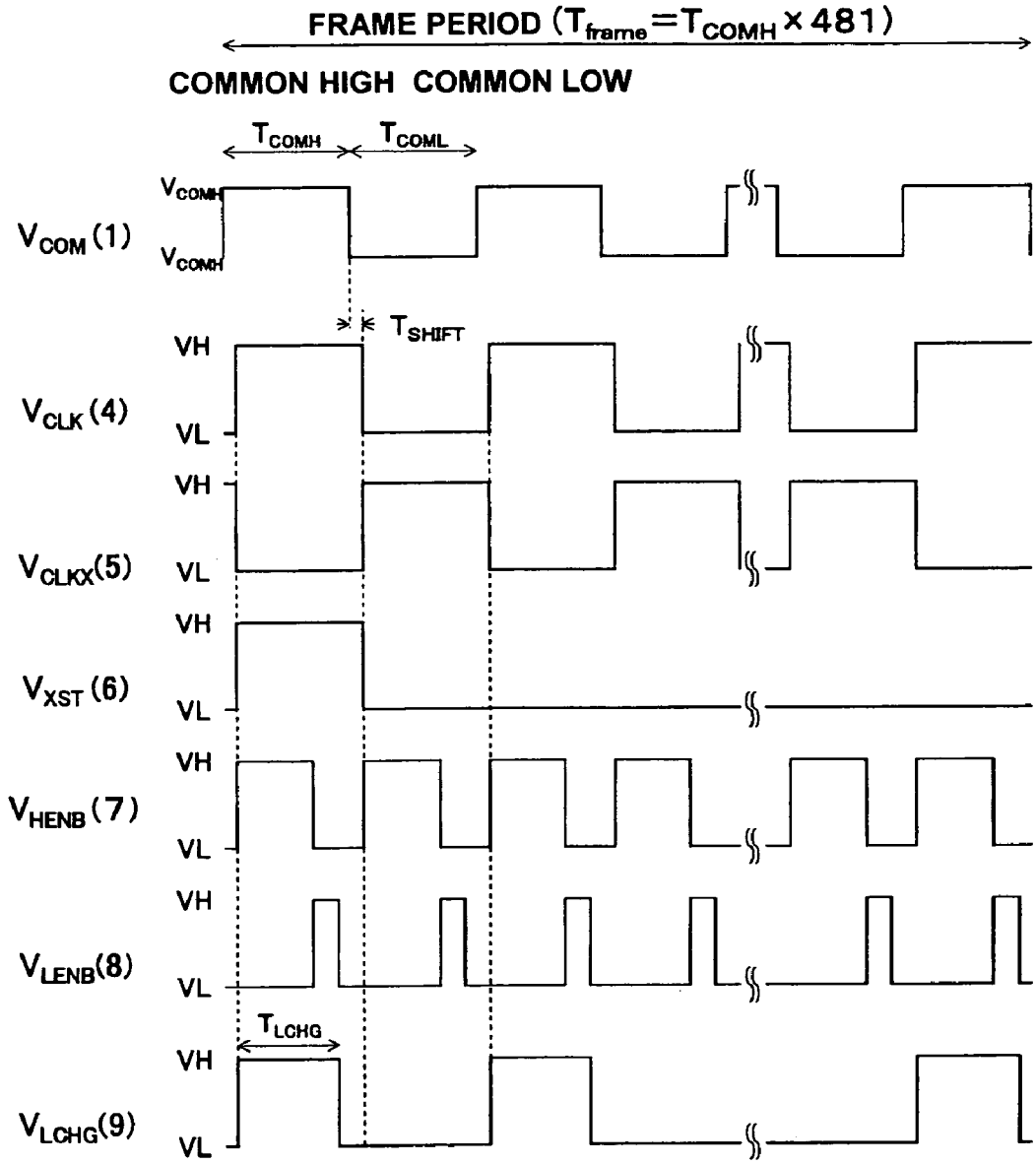
FIG. 10 is a timing chart of each driving signal to be applied from an external signaling system in an odd-numbered frame according to the third embodiment.
Figure 11:
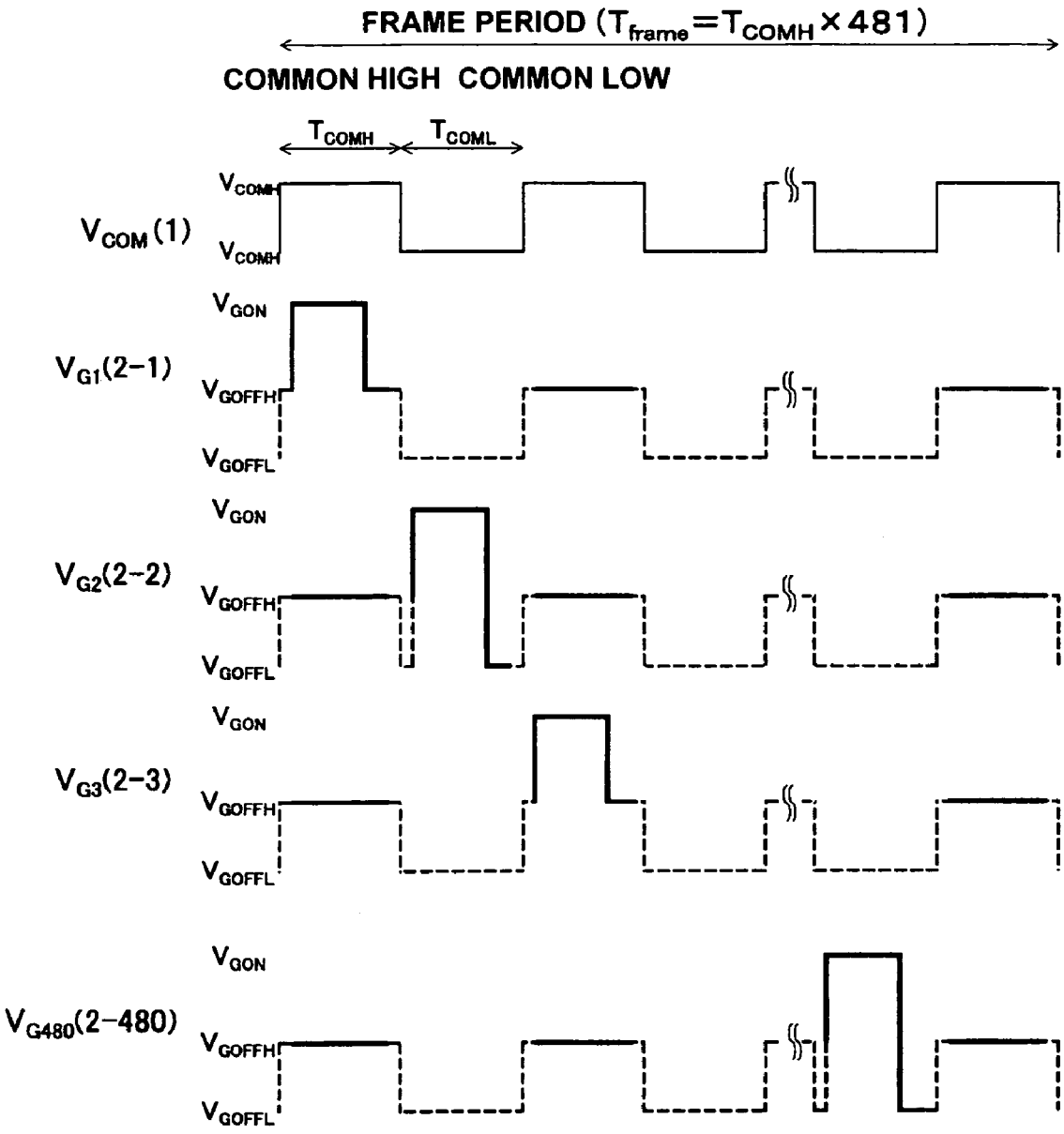
FIG. 11 is an output timing chart of scanning line signals in an odd-numbered frame according to the third embodiment.
Figure 12:
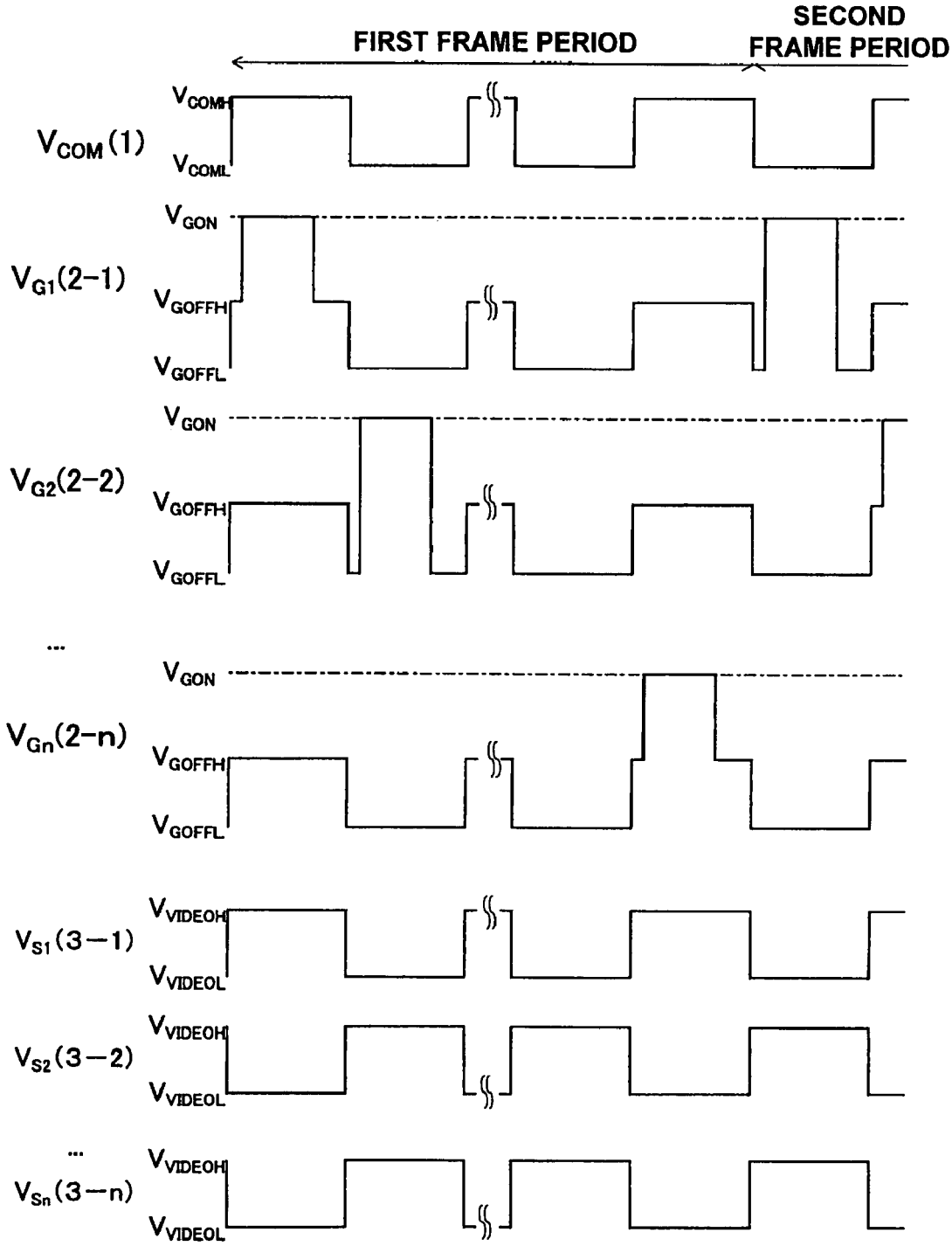
FIG. 12 is a timing chart of signals for explaining a conventional common inversion driving method.

FIGS. 10 and 11 are timing charts showing signals in an odd-numbered frame according to the third embodiment of the present invention for implementing a driving method disclosed in claims 1, 2, 15 and 16. The solid line denotes a state that the power is supplied from an external source, and the dotted line denotes a floating state that each external power sources are blocked with a high resistance.

FIG. 10 is the timing chart showing each signal applied from an external signaling source in an odd-numbered frame according to the third embodiment of the present invention. In this embodiment, a hold time $T_{comH}$ of the potential $V_{comH}$ (hereinafter, referred to as a common high state) is equal to a hold time $T_{comL}$ of the potential $V_{comL}$ (hereinafter, referred to as a common low state), and a period of 481 times of $T_{comH}$ is set to one frame period $T_{frame}$. In addition, the signals $V_{HENB}$ (7) and $V_{LENB}$(8) are not altered during the common high period and the common low period, and is set to a periodical signal having a cycle of $T_{COMH}$. Since the flow chart of video signals supplied thereto is not different from that of the first embodiment, it will be more easily understood with reference to FIG. 4.

FIG. 11 is the timing chart showing output signals applied from the scanning line driving circuit 301 to the scanning lines 201-1 through 480 in an odd-numbered frame according to the third embodiment of the present invention. The non-selection potential is inconstant, and a signal $V_{GOFFH}$ is applied to each scanning line during the common high period and a signal $V_{GOFFL}$ is applied to each scanning line during the common low period. In addition, according to the present embodiment, it is approximately set as $V_{GOFFH}-V_{GOFFL}=V_{COMH}-V_{COML}$.

According to the driving method of the present embodiment, all of 480 scanning lines are in the floating state during the inversion timing from the common high state to the common low state or from the common low state to the common high state. The capacitance during the common inversion is equal to or smaller than that of the first or the second embodiment. It is possible to use the common inversion driving method without degrading display quality in a liquid crystal display device having a big size and a high definition. Therefore, it is possible to use a low-priced and low pressure resistant IC as an IC for outputting video signals and to reduce the power consumption. Furthermore, in comparison with the first and the second embodiments, the present embodiment has shortcomings, such as increases of the number of driving circuits for alternately inverting the signal $V_{GOFF}$, the power consumption, and the number of power potentials. However, since the waveforms of the driving signals become simpler, the configuration of the external signaling circuits can be simpler, accordingly.

In addition, if the leakage currents during the reverse bias of the pixel switching element and the reliability are sufficient from the viewpoint of its performance, the signal $V_{GOFF}$ may be always fixed at the level $V_{GOFFL}$ (even in the common high state) in the third embodiment. In this case, the configuration of the circuit in the device is made to be much simpler.

In addition, the constructural views of the active matrix substrate, the scanning line driving circuit, and the modules in the liquid crystal display device are similar to those of the first and the second embodiments. Therefore, it will be more easily understood with reference to FIGS. 1, 2 and 6.

INDUSTRIAL APPLICABILITY

The present invention is not limited by the embodiments described above, and may be adopted to a variety of applications, such as a liquid crystal display device using a full driver embedded active matrix substrate into which a data line driving circuit is integrated together, and a liquid crystal display device using a driving circuit non-embedded active matrix substrate in which a scanning line driving signal is supplied from an external IC circuit. In addition, with regard to the configuration of the driving circuit, not a complementary circuit such as CMOS but a single channel driving circuit consisting of only the N channel or the P channel may be used to implement the present invention. Also, a P type transistor or a complementary transmission gate may be used as the pixel switching element, and not a poly silicon but an amorphous silicon thin film transistor may be used in the present invention. Furthermore, instead of forming the thin film transistor on an insulating substrate, it is possible to use an active matrix substrate in which the pixel switching element or the driving circuit is formed on the crystalline silicon wafer.

Moreover, not a transmissive type liquid crystal display device described in the embodiments but a reflective or a semi-transmissive liquid crystal display device may be used, and not a direct view type but a projection type light value may be also used. In addition, a normally black mode as well as a normally white mode described in the above embodiments may be used. Particularly, in this case, a vertical alignment mode may be used as an alignment mode of the liquid crystal materials.

What is claimed is:

1. A method of driving a liquid crystal display device, the device comprising a pair of substrates with a liquid crystal layer interposed therebetween, one substrate of the pair of substrates being an active matrix substrate on which a plurality of pixel switching elements, a plurality of scanning lines connected to the plurality of pixel switching elements, and pixel electrodes connected to the plurality of pixel switching elements are provided, and the other substrate of the pair of substrates being an opposing substrate provided with a common electrode on at least a part of a surface contacting the liquid crystal layer, and a scanning line driving circuit being connected to a plurality of scanning lines and sequentially outputting at different timings for every scanning line one or plural selection potentials for making the pixel switching elements connected to the plurality of scanning lines in a low impedance state and one or plural non-selection potentials for making the pixel switching elements connected to the corresponding scanning lines in a high impedance state, and the scanning line driving circuit being connected to a plurality of power source lines of different potentials, wherein the method is a common inversion driving method for alternately inverting a common high state in which the common electrode has a relatively high potential and a common low state in which the common electrode has a relatively low potential, and a common inversion operation in which the potential of the common electrode is changed from the common high state to the common low state and from the common low state to the common high state is implemented in a floating state in which at least a part of the plurality of scanning lines, more preferably, all of the scanning lines or all of the scanning lines except one scanning line are electrically isolated from all of the plurality of power source lines by a relatively high electrical resistance.

2. The method of driving a liquid crystal display device according to claim 1, wherein the pixel switching elements are N channel type field effect transistors, and at the timing when the scanning lines become the floating state, potentials of the corresponding scanning lines are substantially equal to the non-selection potential and the common electrode is in the common high state.

3. The method of driving a liquid crystal display device according to claim 1, wherein the pixel switching elements are P channel type field effect transistors, and at the timing when the scanning lines become the floating state, potentials of the corresponding scanning lines are substantially equal to the non-selection potential and the common electrode is in the common low state.

4. The method of driving a liquid crystal display device according to claim 1, wherein the pixel switching elements are complementary transmission gates each comprising a first switching transistor made of an N channel type field effect transistor and a second switching transistor made of a P channel type field effect transistor, the scanning lines include first scanning lines connected to the first switching transistors and second scanning lines connected to the second switching transistors, at the timing when the first scanning lines become the floating state, potentials of the first scanning lines are substantially equal to the non-selection potential and the common electrode is in the common high state, and at the timing when the second scanning lines become the floating state, potentials of the second scanning lines are substantially equal to the non-selection potential and the common electrode is in the common low state.

5. The method of driving a liquid crystal display device according to claim 1, wherein the plurality of scanning lines have respectively a period of a selection state in which the plurality of scanning lines are connected to a power source of the selection potential with a relatively low electrical resistance, a period of a non-selection state in which the plurality of scanning lines are connected to a power source of the non-selection potential with a relatively low electrical resistance, and a period of the floating state, and wherein the length of the period of the non-selection state is not constant.

6. The method of driving a liquid crystal display device according to claim 1, wherein the plurality of scanning lines have respectively a plurality of non-selection states between the selection state and next selection state and the floating states between the plurality of non-selection states.

7. The method of driving a liquid crystal display device according to claim 6, wherein the pixel switching elements are N channel type field effect transistors, the non-selection states from the second non-selection state of the plurality of non-selection states between the selection states except the non-selection state just after the selection state are executed constantly when the common electrode is in the common high state, and during the non-selection states from the second non-selection state, the common inversion operation is not performed.

8. The method of driving a liquid crystal display device according to claim 6, wherein the pixel switching elements are P channel type field effect transistors, the non-selection states from the second non-selection state of the plurality of non-selection states between the selection states except the non-selection state just after the selection state are executed constantly when the common electrode is in the common low state, and during the non-selection states from the second non-selection state, the common inversion operation is not performed.

9. The method of driving a liquid crystal display device according to claim 1, wherein the length (=TCOMH) of a period in which the common electrode is in the common high state is not equal to the length (=TCOML) of a period in which the common electrode is in the common low state, that is, TCOMH≠TCOML.

10. The method of driving a liquid crystal display device according to claim 9, wherein the pixel switching elements are N channel type field effect transistors, and the TCOMH is larger than the TCOML, that is, TCOMH<TCOML.

11. The method of driving a liquid crystal display device according to claim 9, wherein the pixel switching elements are P channel type field effect transistors, and the TCOMH is smaller than the TCOML, that is, TCOMH<TCOML.

12. The method of driving a liquid crystal display device according to claim 1, wherein the non-selection potential is a substantially constant value (=VGOFF) without depending on the potential of the common electrode.

13. The method of driving a liquid crystal display device according to claim 12, wherein the pixel switching elements are N channel type field effect transistors, and the non-selection potential (=VGOFF) is lower than a value obtained by adding a threshold value (=Vth) of each pixel switching element to the lowest value (=VVIDEOL) of the video signal potentials applied to the data lines and is higher than a value obtained by subtracting a value (=VCOMH−VCOML) from the lowest value of the video signal potentials, the value (=VCOMH−VCOML) being obtained by subtracting the potential (=VCOML) of the common electrode in the common low state from the potential (=VCOMH) of the common electrode in the common high state, that is, a value which satisfies VVIDEOL +Vth>VGOFF>VVIDEOL−(VCOMH−VCOML), more preferably, a value which satisfies a condition of VVIDEOL≧VGOFF≧VVIDEOH−6 (Volt).

14. The method of driving a liquid crystal display device according to claim 12, wherein the pixel switching elements are P channel type field effect transistors, and the non-selection potential (=VGOFF) is higher than a value obtained by adding a threshold value (=Vth) of each pixel switching element to the highest value (=VVIDEOH) of video signal potentials applied to data lines and is lower than a value obtained by adding a value (=VCOMH−VCOML) to the highest value of the video signal potentials, the value (=VCOMH−VCOML) being obtained by subtracting an applied potential (=VCOML) to the common electrode in the common low state from an applied potential (=VCOMH) to the common electrode in the common high state, that is, a value which satisfies VVIDEOH+Vth<VGOFF<VVIDEOH+(VCOMH−VCOML), more preferably, a value which satisfies a condition of VVIDEOH≦VGOFF≦VVIDEOL+6 (Volt).

15. The method of driving a liquid crystal display device according to claim 1, wherein the non-selection potential (=VGOFFH) in the common high state is different from the non-selection potential (=VGOFFL) in the common low state, and they satisfy a condition of VGOFFH>VGOFFL.

16. The method of driving a liquid crystal display device according to claim 1, wherein at least a part of the plurality of data lines, more preferably, all of the plurality of data lines are in the floating state during the common inversion operation.

17. A liquid crystal display device for displaying images by using the method as claimed in claim 1.

18. The liquid crystal display device according to claim 17, wherein a coefficient (=V×V×S) obtained by multiplying a square of the number (=V) of the scanning lines by a diagonal length (=S(m)) of an image display unit in which the pixel electrodes are disposed in a matrix shape is 30000 or more.

19. The liquid crystal display device according to claim 17, wherein the liquid crystal display device is a driving circuit-embedded liquid crystal display device in which at least a part of the scanning line driving circuit is comprised of thin film transistors formed on the active matrix substrate.

20. A battery-driven portable electronic apparatus which functions to display images by using the liquid crystal display device as claimed in claim 17.

* * * * *